US006893807B2

(12) United States Patent
Nomura et al.

(10) Patent No.: US 6,893,807 B2
(45) Date of Patent: May 17, 2005

(54) PHOTOGRAPHIC PROCESSING SYSTEM

(75) Inventors: Hideaki Nomura, Minami-ashigara (JP); Takatoshi Ishikawa, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/638,368

(22) Filed: Aug. 12, 2003

(65) Prior Publication Data

US 2004/0052517 A1 Mar. 18, 2004

(30) Foreign Application Priority Data

Aug. 13, 2002 (JP) ..... 2002-236088

(51) Int. Cl.[7] ..... G03C 5/31; G03C 5/395; G03C 7/44

(52) U.S. Cl. ..... 430/398; 430/399; 430/400

(58) Field of Search ..... 430/398, 399, 430/400

(56) References Cited

U.S. PATENT DOCUMENTS 6,383,727 B1 * 5/2002 Twist et al. ..... 430/398
6,524,780 B2 * 2/2003 Yoshida et al. ..... 430/465

FOREIGN PATENT DOCUMENTS

JP 10-288829 A 10/1998

* cited by examiner

*Primary Examiner*—Hoa Van Le
(74) *Attorney, Agent, or Firm*—Birch, Stewart, Kolasch & Birch, LLP

(57) ABSTRACT

A photographic processing system, which contains: solidifying a photographic processing waste solution, to give a solidified matter thereof; and reusing part of the solidified matter as a solid processing agent.

16 Claims, 1 Drawing Sheet

1. REPLENISHING WATER TANK 2. P1 GRANULAR REPLENISHING AGENT 3. P2 GRANULAR REPLENISHING AGENT 4. REPLENISHING WATER TANK 5. P1 PROCESSING TANK 6. P2 PROCESSING TANK 7. PS PROCESSING TANK 8. WASTE SOLUTION RECOVERY (ABOUT 1L/DAY) 9. SPRAY DRYING 10. NUCLEATION TREATMENT FOR P2 11. MANUFACTURE OF P2 GRANULES 12. REPLENISHING WATER 13. FRSS PROCESSING 14. ANAEROBIC FERMENTATION TREATMENT

1. REPLENISHING WATER TANK 2. P1 GRANULAR REPLENISHING AGENT 3. P2 GRANULAR REPLENISHING AGENT 4. REPLENISHING WATER TANK 5. P1 PROCESSING TANK 6. P2 PROCESSING TANK 7. PS PROCESSING TANK 8. WASTE SOLUTION RECOVERY (ABOUT 1L/DAY) 9. SPRAY DRYING 10. NUCLEATION TREATMENT FOR P2 11. MANUFACTURE OF P2 GRANULES 12. REPLENISHING WATER 13. FRSS PROCESSING 14. ANAEROBIC FERMENTATION TREATMENT

PHOTOGRAPHIC PROCESSING SYSTEM

This nonprovisional application claims priority under 35 U.S.C. § 119(a) on Patent Application No(s). 2002-236088 filed in JAPAN on Aug. 13, 2002, which is (are) herein incorporated by reference.

FIELD OF THE INVENTION

The present invention relates to a photographic processing system in which the photographic processing waste solution can be recycled for use as a solid processing agent of a silver halide photographic light-sensitive material. More specifically, the present invention relates to a photographic processing system in which the photographic processing waste solution can be reused as a solid processing agent of a color photographic light-sensitive material.

BACKGROUND OF THE INVENTION

Generally, the processing of a light-sensitive material is carried out by subjecting the light-sensitive material, after it is exposed, to steps of development, desilvering, water-washing, and drying. The color-developing solution (P1), bleach-fixing solution (P2), and rinsing solution (PS), for use in the steps, are replenished, respectively, by certain amounts, after processing of a light-sensitive material has continued for certain amounts of processing.

In recent years, from the standpoint of environmental loads, regarding the processing of light-sensitive material, there is strong demand for reducing the amount of the waste solution, by reducing the replenishment, and/or by regenerating the waste solution. As a means for reducing the waste solution, an apparatus for concentration by distillation at reduced pressure is already in practical use, and this contributes to reducing the number of repetitions in recovering the waste solution, and the space for storing the waste solution. However, because of widespread use of mini-labs, further-increased efficiency is desired, and reuse of the waste solution becomes an important aim.

An example of reducing the waste solution amount by the manner used conventionally by distillation at reduced pressure, is the method in which the processing waste solution is solidified and powdered, so that the resultant powder is reused as a solid processing agent, as disclosed in JP-A-10-288829 ("JP-A" means unexamined published Japanese patent application). The fixing waste solution contains silver ions, and therefore the silver ion concentration is increased to the extent that desilvering of the light-sensitive material is prevented, if the waste solution is put straight to solidification and powderization, to reuse the resultant powder as a solid processing agent. For this reason, in this mode, the silver ions are removed by electrolysis, etc., before water is removed from the fixing waste solution, and thereafter the waste solution is solidified. The solidified matter is 100% reused, to be regenerated as a solid processing agent, by replenishing the component that is decreased by the development processing.

This system, however, cannot be a preferred mode, because equipment to remove the silver ions is necessary, and space to accommodate the equipment is required, thereby resulting a high cost. In addition, this system cannot solidify a small amount of the waste solution without causing loss.

Further, according to this method, the bleaching effect is reduced by the formation of $Ag_2S$ and the formation of Fe(II) by reduction of the bleaching agent: Fe(III) itself, when the silver ions are electrolytically reduced. As a result of continued rapid running processing while regenerating and reusing the solid processing agent according to this mode, such new problems as fading of cyan color, filter clogging, and staining of the light-sensitive material have occurred.

Still further, the distillation at reduced pressure, serving as the means to reduce the waste solution amount, is not desirable, because it requires a vacuum pump to reduce the pressure, and there is associated concern that applying excessive heat to the waste solution may generate decomposition gases, because the bleach-fixing solution contains ammonium salts and sulfites.

SUMMARY OF THE INVENTION

The present invention resides in a photographic processing system, which comprises: solidifying a photographic processing waste solution, to give a solidified matter thereof; and reusing part of the solidified matter as a solid processing agent.

Other and further features and advantages of the invention will appear more fully from the following description, taken in connection with the accompanying drawing.

DETAILED DESCRIPTION OF THE INVENTION

Figure 1:
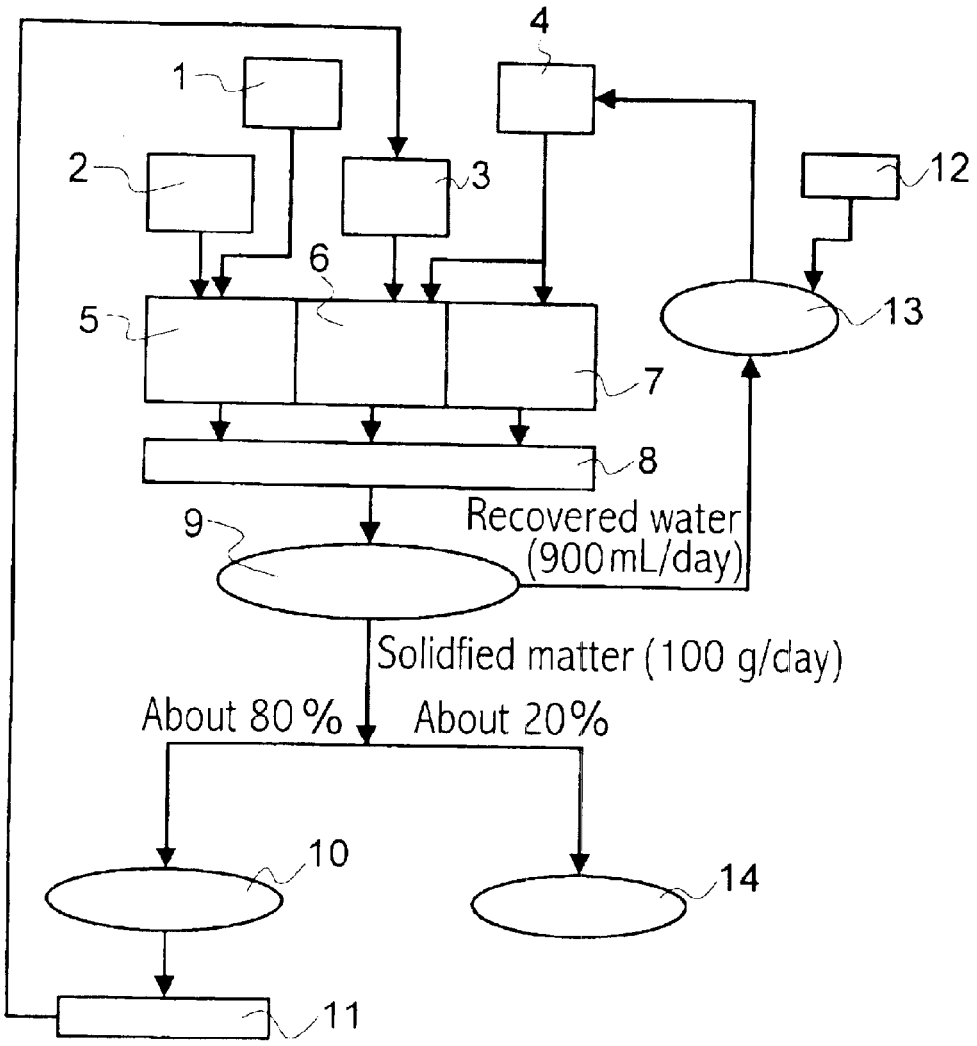
FIG. 1 is a chart illustrating one example of the reuse of a waste solution in the photographic processing system of the present invention.

According to the present invention, there is provided the following means:

(1) A photographic processing system, comprising:

solidifying a photographic processing waste solution, to give a solidified matter thereof; and reusing part of the solidified matter as a solid processing agent;

(2) The photographic processing system according to item (1), wherein the reuse ratio is 50 to 90%;

(3) The photographic processing system according to item (1) or (2), wherein the solidification of the photographic processing waste solution is carried out without removal of silver ions, and the solidified matter is reused as the solid processing agent;

(4) The photographic processing system according to any one of items (1) to (3), wherein spray drying is carried out as a method to obtain the solidified matter from the photographic processing waste solution; and (5) A photographic processing composition, comprising a solid processing agent, which is used for the photographic processing system according to any one of items (1) to (4).

After extensive studies, the present inventors have found that solidifying and powderizing the photographic processing waste solution, which has not subjected to removal of silver ions, and reusing part of the resultant powder as a solid processing agent, enable recycle of the photographic processing waste solution in a simple manner and at low cost without causing such problems as fading of cyan color, filter clogging, and staining of the light-sensitive material by rapid running processing. The present invention was accomplished based on this finding.

The present invention will be explained in detail below.

One of the features of the present invention resides in solidifying a photographic processing waste solution, preferably solidifying and powderizing the photographic processing waste solution by spray drying without removal of silver ions; and reusing part of the resultant solidified matter as a solid processing agent.

In the present invention, it is preferable not to carry out desilvering by electrolysis or the like, as described in JP-A-10-288829. The desilvering needs the specific equipment and space for the installation and thus becomes costly and, as a result, cannot exhibit the effects of the present invention, that is, the reuse of the photographic processing waste solution in a simple way and at low cost. Besides, according to the method involving desilvering, the bleaching effect is reduced by the formation of $Ag_2S$, and by the formation of Fe(II) by the simultaneous reduction of Fe(III) that acts as a bleaching agent, when the silver ions are electrolytically reduced. As a result, the continuation of the rapid running processing while regenerating and reusing the solid processing agent according to this mode, causes such new problems as fading of cyan color, clogging of filter, and staining of the light-sensitive material (these problems are conspicuous, particularly in the case of waste solution from bleach-fixing).

In the present invention, it is preferable to solidify the photographic processing waste solution and to reuse part of the solidified matter as a solid processing agent. The solid processing agent is the photographic processing agent generally in the form of tables, granules, powder, blocks, or paste. Among these, the granular form is preferable.

The reuse of the waste solution in the photographic processing system of the present invention will now be explained referring to FIG. 1. FIG. 1 is a chart illustrating an example of the reuse of the waste solution in the photographic processing system of the present invention.

Generally, the processing of a light-sensitive material comprises the steps of: after subjecting a light-sensitive material to exposure, subjecting the exposed light-sensitive material to color development in a processing tank P1, bleach-fixing in a processing tank P2, subsequently water-washing in a processing tank PS, and drying the light-sensitive material, in the order listed. As stated above, the color-developing solution (P1), the bleach-fixing solution (P2), and the rinsing solution (PS), for use in the steps of the processing of a light-sensitive material, are replenished, respectively, in certain amounts, after processing the light-sensitive material in a certain amount. According to FIG. 1, the processing solution P1 and/or P2 is replenished by placing the granular replenishing agents in respective processing tanks and dissolving the replenishing agents by replenishing water.

In the present invention, the waste solution is recovered from each processing tank and the waste solution is solidified. As to the method for the solidification of the waste solution, a spray drying method using a spray drier or the like is preferable. The conventionally-utilized distillation at a reduced pressure is not desirable because of the apprehension that the application of excessive heat to the waste solution may generate decomposition gases because the bleach-fixing solution contains ammonium salts and sulfites. It has been found that the apprehension of the generation of the decomposition gas is alleviated in the case of the spray drying which is less likely to cause excessive heat in comparison with distillation at a reduced pressure. It has been further found that the use of the solid processing agent obtained by regeneration using spray drying can prevent the staining and the like of the light-sensitive material. Examples of the spray drying equipment that can be used include Spray Drier B-191 (trade name, manufactured by B ÜCHI), and the spray drying equipment described in JP-A-2000-5647, JP-A-58-74101, and the like. Besides, the steam that is generated at the time of solidification of the waste solution can be liquefied by any condensation means, and the thus-liquefied water, after subjected to an FRSS processing if necessary, can be used as the diluent water for the bleach-fixing solution (P2) or the rinsing solution (PS). Herein, the term "FRSS" means Fuji Rinse Saving System (trade name), and an apparatus for making deionized water by using the system is commercially available from Fuji Photo Film Co., Ltd. Alternatively, the liquefied water can also be used for the washing of crossover rollers of P2 and PS.

The solidified waste solution is regenerated as a solid processing agent. As will be stated later, the solid processing agent is produced by granulation of internal nuclei, followed by coating on the internal nuclei. It is preferable that the regenerated solid processing agent is used as the bleach-fixing processing agent (P2). However, when photographic processing is carried out by 100% reuse of the solid processing agent without removal of silver ions, the silver ion concentration in the processing solution increases to the extent that the desilvering of the light-sensitive material is inhibited. Accordingly, the reuse ratio of the waste solution is preferably 50 to 90%, and more preferably 60 to 85%. The term "reuse ratio" means the ratio of the mass of the solidified matter for reuse as replenisher to the total mass of the solidified matter to be obtained from the photographic waste solution, and it is expressed by the following formula:

Reuse ratio(%)={(amount to be used of replenisher derived from the solidified matter obtained from the photographic waste solution (g))÷(the total amount of the solidified matter to be obtained from the photographic waste solution (g))}×100

Besides, it is preferable that the portion which would not be reused as the solid processing agent, undergoes treatments such as anaerobic fermentation and aerobic fermentation, and silver sulfide or sulfur is recovered from the treated waste solution, or the treated waste is used as fertilizer for lawn or the like. Finally, the waste solution is subjected to electrolysis to an environmentally harmless level and is then discharged to a sewer system.

Next, the granular solid processing agent for a silver halide photographic light-sensitive material that can be used as a preferred mode of the system of the present invention is explained in detail. The solid processing agent is preferably the one that is excellent in storage stability, compact, and less hygroscopic during storage and handling, as described in JP-A-2001-183779. The granular solid processing agent having the above-mentioned effects has a core/shell structure. The granular solid processing agent exhibits the effects particularly when a highly hygroscopic component, whose critical relative humidity (the relative humidity of air in the state of moisture equilibrium with the processing agent) of the internal nucleus that is the core is as low as 70% RH or less, is incorporated. Examples of the component, whose critical relative humidity is 70% RH or less include alkali metal hydroxides, thiosulfates, calcium carbonate, hydroxylamine sulfates, and ammonium salts such as ammonium sulfite. The above-mentioned effects are achieved more effectively by the use of the internal nucleus whose critical relative humidity is 60% RH or less. Practically, the internal nucleus whose critical relative humidity is 5% RH or more is used. The above-mentioned effects are remarkable in the case where the internal nucleus contains an alkali metal hydroxide and the alkali metal hydroxide is lithium hydroxide. In the case where the internal nucleus is a thiosulfate, the thiosulfate is preferably an ammonium salt or a sodium salt, and the above-mentioned effects are remarkable particularly when the thiosulfate is an ammonium salt. It is preferable that the internal nucleus contains 50% by mass or more of a component whose critical relative humidity is 70% RH or less, and the above-mentioned effects are remarkable particularly when the proportion of the component is 60 to 100% by mass. Besides, in the case where the alkali metal hydroxide contains water of crystallization, the mass of the alkali metal hydroxide is defined as the mass including that of the water of crystallization. It is preferable that the highly hygroscopic components contained in the internal nucleus are not mixed with other less hygroscopic components. This is because, when the hygroscopic component is mixed with other components, the critical relative humidity of the mixture becomes lower than the values of unit components of the mixture and thus the mixture becomes more hygroscopic. The number of kinds of the components of internal nucleus is preferably 4 or less, more preferably 3 or less, further preferably 2 or less, and most preferably the component is made up of a single substance.

The granular (particle) structure of the granule composed of the internal nucleus and a layer coating the nucleus is one generally referred to as a core/shell structure, wherein the shell layer (coating layer) is a multilayer made up of 3 or more layers. Even if the coating layer is a single layer or a double layer, the core/shell structure inhibits the hygroscopic property of the granule and, as a result, the storage stability is improved. However, one of the preferable features of the present invention resides in employing a multilayer granule made up of 3 or more layers instead of a double layer because the multilayer exhibits distinguishable effects. The multilayer also makes it possible to be made up of the granule constituent compounds of different stable groups. In the solid processing agent that can be used in the photographic processing system of the present invention, the surface of the internal nucleus of an individual granule is covered with 3 or more coating layers. The number of coating layers is preferably 3 to 10, and more preferably 3 to 5. The composition of the coating layer is made up of the components constituting the processing agent that will be described later. It is preferable that the composition of the coating layer is made up of the components constituting the processing agent, excluding an alkali metal hydroxide and a thiosulfate. Besides, from such viewpoints of binding property, stability, and mechanical strength, development-inert substances, such as an inorganic salt and a water-soluble polymer, may be incorporated besides the components constituting the processing agent. It is preferable that the critical relative humidity of the coating layer, that is, the shell is higher than the critical relative humidity of the internal nucleus. It is further preferable that the critical relative humidity of the coating layer is 70% RH or more. The total mass of the coating layer is preferably 0.5 times or more, more preferably 0.7 times or more, and particularly preferably 1.0 time or more the mass of the internal nucleus.

In the manufacture of the granules, the processing agent components constituting the granule are optimally divided between the internal nucleus that is the core component and the coating layer component that is the shell component in accordance with the composite-structured granule design based on known chemical teaching. That is, the constituent components are grouped into (1) a single hygroscopic compound, or a mixture composition made up of the hygroscopic compound and a small amount of other component miscible with the hygroscopic compound; and (2) a mixture composition made up of 3 or more components miscible with one another. Further, the single component or the composition of (1) is used as the internal nucleus, and the single component or the mixture composition of (2) is used as the coating layer composed of 3 or more layers.

Herein, a sphere-shaped granule means a particle prepared by granulating a powder into a sphere. The sphere shape may or may not be a true sphere and includes a spherical form generally referred to as pellet, pill, bead, etc. The average diameter of the granule is preferably 0.5 to 20 mm, further preferably 1 to 15 mm, and particularly preferably 2 to 10 mm. The above-mentioned effects are remarkable if the proportion of the granules having an average diameter of 0.5 mm or less is 10% by mass or less of the granular solid processing agent, and the proportion is particularly preferably 0 to 5% by mass.

In the solid processing agent that can be used in the system of the present invention, the internal nucleus may be granulated into various forms including sphere, column, square pillar, and amorphousness. A sphere is preferable from the standpoint of the coatability of components on the internal nucleus, whereas amorphousness is preferable from the standpoint of ease in the manufacture of the internal nucleus. The average diameter of the internal nucleus is preferably 0.1 to 5 mm, further preferably 0.2 to 4 mm, and very preferably 0.3 to 3 mm. The thickness of each coating layer is generally 0.01 to 5 mm, preferably 0.05 to 2.5 mm, and more preferably 0.1 to 1.5 mm. It is known that the number of coating layers that is specified as 3 or more contributes more than the thickness of each coating layer, to the reduction of the hygroscopicity and improvement of storage stability of the granules.

The granulation of the internal nucleus and the coating onto the internal nucleus can be performed by any of various granulation methods. The granulation methods are described in "Granulation Handbook" (edited by Japan Powder Industry Technologies Association). In addition, granulation methods are described in, for example, JP-A-4-221951, JP-A-2-109043, etc. Among these methods, some illustrative nonlimiting examples include the following methods.

(1) Rolling Granulation Method (Granulation Handbook p.133)

A method, in which raw material powder is placed in a rolling motion (rolling) in a rotary vessel such as a rolling drum or a rolling plate, with the powder being sprayed with a liquid (binder), so that flocculation proceeds by interfacial energy as motive power and granules are formed like snowballs.

(2) Compression Granulation Method (Granulation Handbook p.199)

A method, called briquetting, in which forming by compressing powdery raw material between two rotating rolls whose roll surface has pockets inscribed in briquettes, to conduct size enlargement to form granules; or a method, called compacting, in which powdery raw material is formed into tabular flakes having a smooth surface, and thereafter the flakes are crushed.

(3) Stirring Granulation Method (Granulation Handbook p.379)

A method, in which raw material powder is forcibly given a flowing motion by using stirring blades or the like provided in a vessel, to carry out flocculating granulation while spraying the powder with a liquid.

(4) Extrusion Granulation Method (Granulation Handbook p.169)

A method, in which raw material is extruded from fine holes such as a die or a screen, to form granules. Examples of the extrusion mechanism to be used include those of a screw type, a roll type, a blade type, a self-forming type, or a ram type.

(5) Crushing Granulation Method (Granulation Handbook p.349)

This method includes a dry method and a wet method. The dry method is to crush the briquettes, compact flakes, etc. obtained by the above-described compression granulation, to provide granules. The wet method is to humidify powdery raw material in advance, knead the humidified material, and crush the kneaded matter, thereby conducting granulation. In any of these methods, compress-crushing is carried out using impact by a hammer, or shearing by a cutter, or using gear tooth-type rolls, wave-type (corrugated) rolls, etc.

(6) Fluidized-bed Granulation Method (Granulation Handbook p.283)

A method, in which raw material powder is kept in a suspended state in a fluid blown up from below, while spraying the powder with a binder, to form granules. This operation belongs to a unit operation called fluidizing. In some fluidized-bed multifunctional granulator, the operation is combined with another operation such as rolling and stirring.

(7) Coating Granulation Method (Granulation Handbook p.409)

A granulation method, in which particles are adhered to nucleus surface made by spraying the nucleus with a solution of a binder or a coating substance. Examples of this method includes a pan coating method to perform rolling by means of a rotary drum, a rolling coating method to perform rolling by means of a rotary disk; a fluidized-bed coating method, in which a fluidized bed is formed by air flow; and a centrifugally fluidized coating method, in which planetary motion is created by slit air and centrifugal force by rotation of a rotor.

(8) Fusion Granulation Method (Granulation Handbook p.227)

A method, in which a substance in a fused state is made into particles or flakes thereof by such means as ejection or dropping on a plate, and the resultant particles or flakes are solidified by cooling.

(9) Spray-drying Granulation Method (Granulation Handbook p.249)

A granulation method, in which a solution, a paste, a suspension, or the like is atomized by spraying it into a hot air stream in a drying tower such that the water contained in it is evaporated simultaneously, thereby forming dry particles.

(10) Liquid-phase Granulation Method (Granulation Handbook p.439)

A capsule granulation method known as a method for making microcapsules. Examples of this method includes an interfacial polymerization method, a method of film-hardening in liquid, an emulsification method, a method of interchange of enclosed substances, a spray drying method, etc.

(11) Vacuum-freeze Granulation Method (Granulation Handbook p.469)

A method, using a wet material incapable of maintaining a granular state at normal temperature, and forming granules by utilizing a frozen (solidified by cooling) state.

In the present invention, as stated above, it is particularly preferable to carry out the granulation of the internal nucleus by a spray-drying granulation method. The coating of the internal nucleus is carried out preferably by a rolling granulation method, a fluidized-bed granulation method, or a coating granulation method. A coating granulation method by means of a centrifugal fluidization-type coating machine is particularly preferable because this allows the above-mentioned effects to be effectively exhibited.

It is preferable that the granules thus granulated are surface-coated with a water-soluble polymer. The kind of the water-soluble polymer used in the coating is not particularly limited. Examples of the water-soluble polymer that can be used are one, or two, or more selected from synthetic, semi-synthetic, or naturally-occurring water-soluble polymeric substances, such as gelatins, pectins, polyacrylic acids, polyacrylates, polyvinyl alcohols, modified polyvinyl alcohols, polyvinyl pyrrolidones, polyvinyl pyrrolidone/vinyl acetate copolymers, polyethylene glycols, sodium salts of carboxymethyl cellulose, hydroxypropylmethyl celluloses, hydroxyethyl celluloses, hydroxypropyl celluloses, methyl celluloses, ethyl celluloses, alginates, xanthan gum, gum arabic, tragacanth gum, carraya gum, carrageenan, methyl vinyl ether/maleic anhydride copolymers, etc. Among these substances, the use of one, or two, or more of polyethylene glycol, polyvinyl pyrrolidone, hydroxypropyl cellulose, methyl cellulose, gum arabic, and carrageenan is preferable.

The coating amount of the water-soluble polymer is not particularly limited in so far as it is a coating amount usually employed. The coating amount is preferably 0.001 to 10% by mass, particularly preferably 0.01 to 5% by mass, to the amount of the granules. The coating method of the water-soluble polymer is not particularly limited, and any of known coating methods can be employed. It is preferable to use the above-mentioned rolling granulation method, stirring granulation method, fluidized-bed granulation method, coating granulation method, fusion granulation method, or spray-drying granulation method. In particular, it is preferable to coat the granule surface with an aqueous solution of the polymer having a concentration of 1 to 50%, and then to carry out drying, wherein the coating method is a rolling granulation method, a fluidized-bed granulation method, a coating granulation method, or a spray-drying granulation method.

Next, the composition and form of the development processing agent are explained in detail. The granule-type processing agent may be composed of a single part in which different granules constituting the processing agent are not mixed, or of a part in which plural kinds of granules are mixed. As usually used in the art and defined by International Standard (ISO5989), the term "part" as used herein means a partial constituent of processing agent for constituting the processing agent such that the processing solution is obtained by dissolving the whole parts in a solvent.

The form of the container of the granular processing agent that can be used in the system of the present invention is a bag, a bottle, or the like. The packaging material may be any of paper, plastic, metal, etc. From the standpoint of environmental loading, a bag- or bottle-shaped container made of paper or plastic film is preferable, and the use of biodegradable plastic is particularly preferable. Examples of the biodegradable plastic include hydroxybutylate/hydroxyvalerate polymers, aliphatic polyesters, and polylactic acids. In addition, from the standpoint of various kinds of stability, a packaging material having a barrier property is preferable. In particular, a plastic material whose oxygen transmittance is 200 $mL/m^2 \cdot 24\ hrs \cdot Pa$ or less is preferable. The oxygen transmittance coefficient can be measured in accordance with the method described on pages 143 to 145, December, of "$O_2$ permeation of plastic container, Modern Packing"; by N. J. Calyan, 1968. Specific examples of the preferable plastic material include vinylidene chloride (PVDC), nylon (polyamide, NY), polyethylene (PE), polypropylene (PP), polyester (PES), ethylene/vinyl acetate copolymer (EVA), ethylene/vinyl alcohol copolymer (EVAL), polyacrylonitrile (PAN), polyvinyl alcohol (PVA), and polyethylene terephthalate (PET). For the purpose of the reduction of oxygen transmittance, the use of PVDC, NY, PE, EVA, EVAL, and PET is preferable.

As to the specific packaging form of the granular processing agent, a film, a bag, or a bottle is used. In the case of the solid photographic processing agent packaged by means of a film having a barrier property, a film having a thickness of 10 to 150 $\mu$m is preferable in order to protect the processing agent from moisture. For this reason, the barrier-packaging material to be used is preferably at least one of or a composite material using materials selected from polyethylene terephthalate, films of a polyolefin such as polyethylene or polypropylene, kraft papers made moisture-resistant by polyethylene, waxed papers, moisture-resistant cellophanes, glassine, polyesters, polystyrenes, polyvinyl chlorides, vinylidene chloride/maleic acid copolymers, polyvinylidene chlorides, polyamides, polycarbonates, acrylonitriles, foils of metal such as aluminum, and metallized polymer films.

The use of a high-barrier (high sealing) film packaging material, which is made of, for example, (1) polyethylene terephthalate/low-density polyethylene, (2) vinylidene chloride/maleic acid copolymer-coated cellophane/low-density polyethylene, (3) polyethylene terephthalate/(vinylidene chloride/maleic acid copolymer)/low-density polyethylene, (4) nylon/low-density polyethylene, (5) low-density polyethylene/(vinylidene chloride/maleic acid copolymer)/low-density polyethylene, (6) nylon/Epal/low-density polyethylene, (7) polyethylene terephthalate/Epal/low-density polyethylene, or (8) a composite material such as polyethylene terephthalate vacuum-deposited with aluminum, is particularly preferable, from the standpoints of high barrier property against water, gas, light, etc., fastness, flexible sealing (processing) property, and the like. These high-barrier packaging materials that can be used are those described in "New Developments of Functional Packaging Materials" (Toray Research Center, February, 1990).

Also usable as preferred container materials are the containers having low-oxygen transmittance and low-steam transmittance, as disclosed in JP-A-63-17453, and the vacuum-packaging materials disclosed in JP-A-4-19655, and JP-A-4-230748.

As one mode of the granular processing agent that can be used in the system of the present invention, a container filled with the processing agent can be attached to an automatic processor so that the processing agent is supplied for the development processing. In that case, a preferred example of the container is the one made of a high-density polyethylene (hereinafter referred to as HDPE), which has a density (g/cm$^3$) of 0.941 to 0.969 and a melt index falling within the range of 0.3 to 5.0 g/10-min, as a single constituent resin. A preferable density is 0.951 to 0.969 and a more preferable density is 0.955 to 0.965. A preferable melt index is 0.3 to 5.0 and a more preferable melt index is 0.3 to 4.0. The melt index is a value measured in accordance to the method specified in ASTM D1238, under a load of 2.16 kg at temperature of 190° C. It is preferable that the thickness of the container is 500 to 1500 $\mu$m. However, the container to be used for the processing agent that can be used in the system of the present invention is not limited to the above-mentioned HDPE container advantageous in the attachment to a processor. Accordingly, containers made of a general-purpose container material other than HDPE, such as polyethylene terephthalate (PET), polyvinyl chloride (PVC), and low-density polyethylene (LDPE), and containers made of HDPE having a density and a melt index falling outside the above-mentioned ranges, can also be used.

In the above, the structure of the granular processing agent and method of making the agent are explained. Next, the chemical substances constituting the processing agents for use in the processing system of the present invention will be explained. The solid processing agent usable in the system of the present invention can be used in any processing agent such as bleaching solution, fixing solution, bleach-fixing solution, and stabilizing solution if necessary, in any processing agent for color photographic light-sensitive material and for black-and-white photographic light-sensitive material, and in any processing agent for photographing and printing. In the case where the waste solution from a developing solution alone is collected and solidified, the solid processing agent can also be used in the developing solution.

In some cases, the terms "development" and "development processing", and "developing agent" and "development processing agent" are used in a wide sense generally indicating a series of steps from a development step to a drying step and the processing agent for the series of steps, respectively; while, in other cases, these terms are used in a narrow sense indicating only a development step and the processing agent for the development step, respectively. Herein, in the description of the present specification, if the terms are unclear regarding which of the senses is indicated, even from before and after the sentence, the wide sense is expressed as "processing" or "processing agent", while the narrow sense is expressed as "development" or "development (processing) agent".

First, the components constituting the color-developing agent for use in the system of the present invention will be explained. A preferable example of the color-developing agent is a known aromatic primary amine color-developing agent, in particular a p-phenylenediamine derivative. Some illustrative nonlimiting examples are given bellow.

1) N,N-diethyl-p-phenylenediamine
2) 4-amino-N,N-diethyl-3-methylaniline
3) 4-amino-N-(β-hydroxyethyl)-N-methylaniline
4) 4-amino-N-ethyl-N-(β-hydroxyethyl)aniline
5) 4-amino-N-ethyl-N-(β-hydroxyethyl)-3-methylaniline
6) 4-amino-N-ethyl-N-(3-hydroxypropyl)-3-methylaniline
7) 4-amino-N-ethyl-N-(4-hydroxybutyl)-3-methylaniline
8) 4-amino-N-ethyl-N-(β-methanesulfonamidoethyl)-3-methylaniline
9) 4-amino-N,N-diethyl-3-(β-hydroxyethyl)aniline
10) 4-amino-N-ethyl-N-(β-methoxyethyl)-3-methylaniline
11) 4-amino-N-(β-ethoxyethyl)-N-ethyl-3-methylaniline
12) 4-amino-N-(3-carbamoylpropyl)-N-n-propyl-3-methylaniline
13) 4-amino-N-(4-carbamoylbutyl)-N-n-propyl-3-methylaniline
14) N-(4-amino-3-methylphenyl)-3-hydroxypyrrolidine
15) N-(4-amino-3-methylphenyl)-3-(hydroxymethyl) pyrrolidine
16) N-(4-amino-3-methylphenyl)-3-pyrrolidinecarboxyamide Among the aforementioned p-phenylenediamine derivatives, the exemplified compounds 5), 6), 7), 8) and 12) are particularly preferable, and among these compounds, the compounds 5) and 8) are further preferable. These p-phenylenediamine derivatives are generally in the form of a salt, such as a sulfate, hydrochloride, sulfite, naphthalene disulfonate and p-toluene sulfonate, in the state of a solid material. When used, the granulated processing agent composition is mixed with water at a predetermined ratio, and the resultant mixture is used as a working solution in the form of a developing solution or a development replenisher solution (both of these solutions are hereinafter collectively referred to as developing solution if it is not specifically meaningful to distinguish a developing solution form a development replenisher. The same applies to a developing agent and a development replenisher agent). The content of the aromatic primary amine developing agent in the processing agent is determined such that the concentration of the developing agent in the working solution is generally 2 to 200 mmol, preferably 6 to 100 mmol, more preferably 10 to 40 mmol, per liter of the developing solution.

Depending on the kind of the subject light-sensitive material, the color developer may contain a small amount of sulfite ions, or it may contain substantially no sulfite ions. In the present invention, it is preferable that the color developer contains a small amount of sulfite ions. Although the sulfite ions provide a remarkable preservative effect, an excess of the sulfite ions may adversely affect the photographic performance in the color-development process. In addition, the color developer may contain a small amount of hydroxylamine. If the hydroxylamine (generally in the form of a hydrochloric acid salt or in the form of a sulfuric acid salt, but the description of the form of the salt is omitted hereinafter) is incorporated, the hydroxylamine acts as a preservative of the developing solution similarly in the case of the sulfite ions. On the other hand, however, since the hydroxylamine itself is active in silver development and thus affects the photographic performance, the amount of the hydroxylamine to be added also needs to be a small amount.

The color developer may contain, as a preservative, an organic preservative, in addition to the aforementioned hydroxylamine and sulfite ions. Here, the organic preservative means whole the organic compounds which decrease the deterioration speed of aromatic primary amine color-developing agents when it is added to a processing solution of a light-sensitive material. Namely, the preservative is any of organic compounds having the ability of preventing the oxidation of a color-developing agent caused by oxygen and the like. Among these organic compounds, particularly effective organic preservatives are hydroxylamine derivatives (excluding hydroxylamine, the same as follows), hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds, and amines having fused rings. These compounds are disclosed in each publication or specification of JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. No. 3,615,503, U.S. Pat. No. 2,494,903, JP-A-52-143020, and JP-B-48-30496 ("JP-B" means examined Japanese patent publication).

Further, other preservatives that may be contained, if required, include, for example, various metals described in JP-A-57-44148 and JP-A-57-53749, salicylic acids described in JP-A-59-180588, alkanolamines described in JP-A-54-3532, polyethyleneimines described in JP-A-56-94349, and aromatic polyhydroxy compounds described in U.S. Pat. No. 3,746,544. In particular, for example, alkanolamines, such as triethanolamine and triisopropanolamine; substituted or unsubstituted dialkylhydroxylamines, such as disulfoethylhydroxylamine and diethylhydroxylamine; and aromatic polyhydroxy compounds can be added. Among the above organic preservatives, details of hydroxylamine derivatives are described, for example, in JP-A-1-97953, JP-A-1-186939, JP-A-1-186940, and JP-A-1-187557. In particular, the addition of a hydroxylamine derivative together with an amine may be effective in terms of the improvement of the stability of the color-developing solution and the improvement of the stability when the processing is carried out under a continuous manner. Examples of the amine include cyclic amines described in JP-A-63-239447, amines described in JP-A-63-128340, and amines described in JP-A-1-186939 and JP-A-1-187557. Although the contents of the preservative in the processing agent vary depending on the kinds of the preservative, the preservative is added such that the concentration in the working solution is generally 1 to 200 mmol, preferably 10 to 100 mmol, per liter of the developing solution.

A color-developing agent, for example, a developing agent for color paper, may be added chloride ions, if necessary. In many cases, a color-developing solution (particularly a developing agent for color print materials) contains chloride ions at a concentration of generally $3.5\times10^{-2}$ to $1.5\times10^{-1}$ mol/liter. However, since chloride ions are usually liberated as a by product of development into the developing solution, the addition of chloride ions to the replenisher-developing agent is often unnecessary. The developing agent of light-sensitive material for photographing may not contain chloride ions.

As for bromide ions, it is preferable that the concentration of bromide ions in the color-developing solution is about 1 to $5\times10^{-3}$ mol/liter in the processing of a material for photographing and that the concentration of bromide ions in the color-developing solution is $1.0\times10^{-3}$ mol/liter or less in the processing of a material for print. However, the addition of bromide ions to the color-developing agent is often unnecessary as in the case of the chloride ions. In the case where bromide ions are added, the bromide ions may be added to the processing agent such that the concentration of the bromide ions falls within the above-mentioned range, as necessary. The same applies to iodide ions in the case where the subject light-sensitive material is obtained from a silver iodobromide emulsion such as a color negative film and a color reversal film. Since iodide ions are usually liberated from the light-sensitive material so that the concentration of the iodide ion becomes about 0.5 to 10 mg/liter of the developing solution, generally the replenisher processing agent does not contain iodide ions.

In the case where a halide is used as an additive component for a developing agent or a development replenisher, examples of chloride ion supplying substances include sodium chloride, potassium chloride, ammonium chloride, lithium chloride, nickel chloride, magnesium chloride, manganese chloride, and calcium chloride. Among these examples, preferred substances are sodium chloride and potassium chloride. Examples of bromide ion supplying substances include sodium bromide, potassium bromide, ammonium bromide, lithium bromide, calcium bromide, magnesium bromide, manganese bromide, nickel bromide, cerium bromide, and thallium bromide. Among these examples, preferred substances are potassium bromide and sodium bromide. Examples of iodide ion supplying substances are sodium iodide and potassium iodide.

In the present invention, it is preferable that the addition is made such that pH of the developing solution is kept at 9.0 to 13.5 and pH of the replenisher solution is kept at 9.0 to 13.5. For this reason, the developing solution and the replenisher solution may each contain an alkali agent, a buffering agent, and, if necessary, an acid agent, so that the pH can be maintained. The internal nucleus of the granular processing agent may contain a hydroxide as an alkali agent. Examples of the alkali agent include potassium hydroxide, sodium hydroxide, lithium hydroxide, potassium tertiary phosphate, sodium tertiary phosphate, and hydrates thereof. Further, as another liquid part different from the granular agent, triethanolamine or diethanolamine may be added. The acid agent that is added as necessary can be an inorganic or organic acid in the form of a water-soluble solid. Examples of such an acid include succinic acid, tartaric acid, propionic acid, and ascorbic acid.

In order to maintain the above-mentioned pH value, it is preferable to use a buffering agent when a processing solution is prepared. Examples of the buffering agent that can be used include carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminolactic acid salts, 2-amino-2-methyl-1,3-propanediol salts, valine salts, proline salts, trishydroxyaminomethane salts, and lysine salts. In particular, carbonates, phosphates, tetraborates, and hydroxybenzoates are advantageous because these buffering agents are excellent in the buffering performance in a high pH region having a pH value of 9.0 or more, do not exhibit adverse effects (such as fogging) to photographic performances when added to a color-developing solution, and are inexpensive. Therefore, the use of these buffering agents are particularly preferable.

Specific examples of these buffering agents include sodium carbonate, potassium carbonate, sodium hydrogencarbonate, potassium hydrogencarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2hydroxybenzoate (potassium 5-sulfosalicylate). The present invention, however, is not limited to these compounds. Since the buffer is not the component that reacts or is consumed, the amount of the buffer to be added in the composition is determined such that the concentration of the buffering agent is generally 0.01 to 2 mol, preferably 0.1 to 0.5 mol, per liter of both the developing solution and the replenisher, each of which is prepared from the processing agent.

In addition, in a color developer, can be added another color-developer component(s), for example, various chelating agents that act as a precipitation-preventing agent against calcium and magnesium, or as an agent for improving stability of the color developer. Examples of the chelating agent include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine orthohydroxyphenylacetic acid, ethylenediaminesuccinic acid (S,S-form), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, 1,2-dihydroxybenzene-4,6-disulfonic acid, and the like. These chelating agents may be used in combination of tow or more of these, if necessary. With respect to the amount of the chelating agent to be added, preferably the amount is enough to sequester the metal ions in the prepared color developer, for example, in an amount of about 0.1 to 10 g per liter.

To the color-developing agent that can be used in the present invention, if necessary, an arbitrary development accelerator can be added. Examples of the development accelerator are the following compounds: thioether compounds described, for example, in JP-B-37-16088, JP-B-37-5987, JP-B-38-7826, JP-B-44-12380, JP-B-45-9019, and U.S. Pat. No. 3,813,247; p-phenylenediamine compounds described in JP-A-52-49829 and JP-A-50-15554; quaternary ammonium salts described, for example, in JP-A-50-137726, JP-B-44-30074, and JP-A-56-156826 and JP-A-52-43429; amine compounds described, for example, in U.S. Pat. Nos. 2,494,903, 3,128,182, 4,230,796, and 3,253,919, JP-B-41-11431, and U.S. Pat. Nos. 2,482,546, 2,596,926, and 3,582,346; polyalkylene oxides described, for example, in JP-B-37-16088, JP-B-42-25201, U.S. Pat. No. 3,128,183, JP-B-41-11431, JP-B-42-23883, and U.S. Pat. No. 3,532,501; and 1-phenyl-3-pyrazolidones and imidazoles, each of which compounds can be added, if necessary. The amount to be added in the composition is determined such that the concentration of the compound would be generally 0.001 to 0.2 mol, preferably 0.01 to 0.05 mol, per liter for both the developing solution and the replenisher, each of which is prepared from the processing agent.

An arbitrary antifoggant may be added to the color-development agent for use in the present invention, as needed, besides the above-describe halide ions. Examples of the organic antifoggant include nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, and adenine. Further, if necessary, various surface-active agents, such as alkylsulfonic acids, arylsulfonic acids, aliphatic carboxylic acids, and aromatic carboxylic acids, may be added to the color-developing agent. The amount to be added of the surfactant in the composition is determined such that the concentration thereof would be generally 0.001 to 0.2 mol, preferably 0.01 to 0.05 mol, per liter for both the developing solution and the replenisher, each of which is prepared from the processing agent.

In the above, the color-developing agent for use in the present invention is explained. Next, the structure of a black-and-white developing agent will be explained. A conventionally known developing agent can be used as the black-and-white developing agent. Developing agents that can be used are dihydroxybenzenes (e.g., hydroquinone, hydroquinone monosulfonate, and catechol), 3-pyrazolidones (e.g., 1-phenyl-3-pyrazolidone, 1-phenyl-4-methyl-4-hydroxymethyl-3-pyrazolidone, and 1-phenyl-4,4-dihydroxymethyl-3-pyrazolidone), aminophenols (e.g., N-methyl-p-aminophenol, N-methyl-3-methyl-p-aminophenol, and N-methyl-2-sulfoaminoaminophenol), ascorbic acid and erythorbic acid, as well as isomers and derivatives thereof, and p-phenylenediamines to be used also as a color-developing agent that is described in the above. These developing agents can be used singly or in a combination thereof. In the case where these developing agents are used in the forms of salts, examples of the salts formed with counter ions include sulfuric acid salts, hydrochloric acid salts, phosphatic acid salts, p-toluenesulfonic acid salts, etc. The amount to be added of the developing agent is preferably $1\times10^{-5}$ to 2 mol/liter, per liter of the developing solution to be prepared.

If necessary, a preservative can be used for the black-and-white developing agent. A sulfite or a hydrogensulfite is generally used as the preservative. The preservative is added such that the concentration thereof in the developing solution to be prepared is generally 0.01 to 1 mol per liter and preferably 0.1 to 0.5 mol per liter. Besides, ascorbic acid is also an effective preservative, and a preferred amount thereof to be added is such an amount that the concentration in the prepared developing solution would be 0.01 to 0.5 mol per liter. Further, hydroxylamines, sugars, o-hydroxyketones, hydrazines, etc. can also be used. The amount thereof to be added is such an amount that the concentration in the prepared developing solution would be 0.002 to 1.0 mol per liter.

The pH of the black-and-white developer is preferably 8 to 13 and more preferably 9 to 12. To keep the above pH range, the development processing agent may be added an alkali agent, a buffering agent, and, if necessary, an acid agent. Preferred examples of the alkali agent, buffering agent, and acid agent are those listed in the explanation of the color-developing agent. Other examples of the buffering agent include hydroxybenzoates, glycine salts, N,N-dimethylglycine salts, leucine salts, norleucine salts, guanine salts, 3,4-dihydroxyphenylalanine salts, alanine salts, aminobutyric acid salts, valine salts, and lysine salts. In these buffering agents, the counter ion to form the salt may be an alkali metal such as Na or K or ammonium. These buffer agents may be sued singly or in a combination of two or more kinds of these.

The black-and-white developer may also contain a silver halide solvent as a development accelerator. In that case, examples of the accelerator to be used include thiocyanates, sulfites, thiosulfates, 2-methylimidazoles, tertiary amines, polyethylene oxides, 1-pheny-3-pyrazolidones, primary amines, N,N,N',N'-tetramethyl-p-phenylenediamines, thioether-based compounds described in JP-A-57-63580, and the accelerators described in the explanation of the color-developing agent. It is preferable that the amount of these compounds to be added is such an amount that the concentration in the prepared developing solution (development replenisher) is about 0.005 to 0.5 mol per liter.

In order to prevent development fog, the granular, black-and-white developing agent for use in the present invention may also be added the various fogging-preventing agents (anti-foggants) described in the explanation of the color-developing agent.

Further, the black-and-white processing solution for use in the present invention may also contain a swelling-preventing agent (e.g., an inorganic salt such as sodium sulfate or potassium sulfate), and a softener for hard water. Still further, if necessary, the black-and-white processing solution may contain a softener for hard water and a surfactant described in the explanation of the color-developing agent at the same concentration levels as described in the above.

The development processing agent is all described above. Next, the processing agents in the desilvering process will be explained. First, bleaching agent for the bleaching solution and the bleach-fixing solution in the color-development processing will be explained. The bleaching agent for use in the bleaching solution and in the bleach-fixing solution may be conventionally known one. Particularly, organic complex salts of iron (III) (e.g., complex salts of aminopolycarboxylic acids), organic acids such as citric acid, tartaric acid, and malic acid, persulfate, and hydrogen peroxide, etc. are preferable.

Among them, organic complex salts of iron (III) are particularly preferred from the viewpoint of rapid processability and prevention of environmental pollution. Examples of aminopolycarboxylic acid or its salts useful for forming organic complex salts of iron (III) include ethylenediaminedisuccinic acid (S,S-form), N-(2-carboxylatoethyl)-L-aspartic acid, β-alaninediacetic acid, and methyliminodiacetic acid, which are all biodegradable, as well as ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid, glycol ether diamine tetraacetic acid, and the like compounds. These compounds may be any one of sodium, potassium, lithium and ammonium salts. Among these compounds, ethylenediaminedisuccinic acid (S,S-form), N-(2-carboxylatoethyl)-L-aspartic acid, β-alaninediacetic acid, ethylenediaminetetraacetic acid, 1,3-diaminopropanetetraacetic acid, and methyliminodiacetic acid are preferable since the resulting iron (III) complex salt has good photographic properties. The ferric ion complex salts may be used in the form of a complex salt. Alternatively, a ferric iron salt, for example, ferric sulfate, ferric chloride, ferric nitrate, ferric ammonium sulfate, ferric phosphate, or the like, and a chelating agent, such as aminopolycarboxylic acid, may be mixed to form a ferric iron ion complex salt in a solution. Alternatively, a chelating agent may be used in an excessive amount that is more than what is necessary for forming ferric iron complex salt. Among these iron complexes, an iron aminopolycarboxylate complex is preferable.

The amount to be added of bleaching agent is determined so that the concentration in a prepared processing solution would be generally 0.01 to 1.0 mol/l, preferably 0.03 to 0.80 mol/l, more preferably 0.05 to 0.70 mol/l, and further preferably 0.07 to 0.50 mol/l.

It is preferable that the bleaching agent (bleaching solution), the bleach-fixing agent (blix solution), and the fixing agent (fixing solution) each contain various conventionally-known organic acids (e.g., glycolic acid, succinic acid, maleic acid, malonic acid, citric acid, and sulfosuccinic acid), organic bases (e.g., imidazole and dimethylimidazole), the compounds including 2-picolinic acid represented by the formula (A-a) described in JP-A-9-211819, and the compounds including kojic acid represented by the formula (B-b) described in the above JP-A-9-211819. The amounts of these compounds to be added are determined such that the concentrations would be preferably 0.005 to 3.0 mol, more preferably 0.05 to 1.5 mol, per liter in the prepared processing solution.

Next, fixing agents (including those of bleach-fixing agents for color) for color and black-and-white processings will be collectively explained. The compound to be used as the bleach-fixing agent or fixing agent may be any of conventionally-known chemicals for fixation. That is, the compounds are water-soluble silver halide solvents, such as thiosulfates, e.g., sodium thiosulfate and ammonium thiosulfate, thiocyanates, e.g., sodium thiocyanate and ammonium thiocyanate, thioether compounds, e.g., ethylene-bisthioglycolic acid and 3,6-dithia-1,8-octanediol, thioureas, etc. These compounds may be used singly or in a combination of two or more. Further, as described in JP-A-55-155354, for example, a special bleach-fixing solution composed of a combination of a fixing agent and a halide such as a large amount of potassium iodide, can also be used. In the present invention, the use of a thiosulfate, ammonium thiosulfate, in particular, is preferable. The concentration of the chemical for fixation in the fixing solution and bleach-fixing solution that are prepared from the granular processing agent, is preferably 0.3 to 3.0 mol, more preferably 0.5 to 2.0 mol, per liter of the prepared solution.

When the bleach-fixing agent and fixing agent are dissolved, the pH range in the present invention is preferably 3 to 8 and more preferably 4 to 8. If the pH is too low, deterioration of the solution and conversion of the cyan dye into leuco are accelerated, although desilvering performance is raised. On the other hand, if the pH is too high, desilvering is delayed and stains tend to occur easily. The pH range of the bleaching solution that is prepared from the granular processing agent usable in the system of the present invention is generally 8 or less, preferably 2 to 7, and particularly preferably 2 to 6. If the pH is too low, deterioration of the solution and conversion of the cyan dye into leuco are accelerated. On the other hand, if the pH is too high, desilvering is delayed and stains tend to occur easily. In order to adjust the pH, if necessary, it is possible to add the aforementioned solid acids, solid alkalis, i.e., potassium hydroxide, sodium hydroxide, lithium hydroxide, lithium carbonate, sodium carbonate, and potassium carbonate, acidic or alkaline buffering agents, etc.

In addition, the bleach-fixing agent may contain a fluorescent brightening agent, a defoaming agent, a surfactant, polyvinylpyrrolidone, etc. The fluorescent brightening agent may be incorporated in the developing solution prepared using the color-developing agent such that the concentration of the fluorescent brightening agent would be 0.02 to 1.0 mol/liter. It is preferable that the bleach-fixing agent and bleaching agent contain, as a preservative, a sulfite ion-releasing compound, for example, a sulfite (e.g., sodium sulfite, potassium sulfite, ammonium sulfite, or the like), a hydrogensulfite (e.g., ammonium hydrogensulfite, sodium hydrogensulfite, potassium hydrogensulfite, or like), or a metahydrogensulfite (e.g., potassium metahydrogensulfite, sodium metahydrogensulfite, ammonium metahydrogensulfite, or like), and/or an aryl sulfinic acid such as p-toluenesulfinic acid or m-carboxybenzenesulfinic acid. The contents of these compounds, in terms of sulfite ion or sulfinic acid ion, are preferably about 0.02 to 1.0 mol/liter.

As a preservative, besides those mentioned above, such compounds as ascorbic acid, a carbonyl-hydrogensulfurous acid adduct, or a carbonyl compound may be added.

After the completion of fixing or bleach-fixing, a stabilization bath as a substitute for water-washing or a stabilization bath for image stabilization is often used. Since these baths are operated at a low concentration, the effects of granular processing agents are not large. However, the granular processing agents may be prepared if necessary. The methods for decreasing calcium and magnesium, which are described in JP-A-62-288838, can be applied very effectively to the processing agents for the stabilization baths. In addition, isothiazolone compounds and thiabendazoles described in JP-A-57-8542, chlorine-based bactericides such as sodium salt of chlorinated isocyanuric acid described in JP-A-61-120145, benzotriazole and copper ions described in JP-A-61-267761, bactericides described in "Chemistry of the Prevention of Bacteria and Fungi" (1986), by Hiroshi Horiguchi, Sankyo Publishing Co., Ltd., bactericides described in "Reduction and Sterilization of Microorganisms and Fugni-Preventing Technologies" (1982), ed., Eisei Gijutsu Kai, and bactericides described in "Dictionary of Bacteria and Fungi Preventing Agents", ed., Kogyo Gijutsu Kai, Japan Microorganisms and Fugni-Preventing Technologies Association (1986) can also be used.

Also, it is possible to add aldehydes, e.g., formaldehyde, acetaldehyde, and pyruvaldehyde, which inactivate the remaining magenta coupler so that the fading of a dye and stain formation are prevented, methylol compounds and hexamethylenetetramine described in U.S. Pat. No. 4,786,583, hexahydrotriazines described in JP-A-2-153348, a formaldehyde-hydrogensulfurous acid adduct described in U.S. Pat. No. 4,921,779, and azolylmethylamines described in European Patents No. EP 0504609, No. 0519190, etc. It is also possible to use a surfactant as a draining agent, and a chelating agent represented by EDTA as a softener for hard water.

In the above, the components constituting the processing agent for use in the system of the present invention are described. Next, the processing process using the processing agent in the system of the present invention will be explained. In the case of a color photographic light-sensitive material, the development processing to which the present invention is applied includes a color-development step, a desilvering step, a water-washing or stabilization bath step, and a drying step. An auxiliary step, such as a rinsing step, an intermediate water-washing step, or a neutralization step, can be placed between the above-mentioned steps. The desilvering step can be carried out as a one-step process using a bleach-fixing solution or a two-step process composed of a bleaching step and a fixing step. Beside a stabilization bath as a substitute for water-washing step, an image stabilization bath for the stabilization of an image can be provided between the water-washing or stabilization bath step and the drying step. In the case of a black-and-white photographic light-sensitive material, the process includes a development step, a fixing step, a water-washing step, and a drying step. An auxiliary step, such as an intermediate water-washing step including rinse or a neutralization step, can be placed between the above-mentioned steps. The processing method in the present invention may be any of a rapid development method, a low-replenishment method, and a standard method that is internationally interchangeable.

The color or black-and-white development step is an immersion process step of immersing a light-sensitive material in a developing solution. The developing solution is an alkaline liquid in a continuous phase containing the constitution components in a dissolved state. A developing solution prepared is used in the developing tank and a development replenisher prepared is used in the replenisher tank.

In the case where the light-sensitive material to be development-processed is a color photographic material for shooting like a color negative or color reversal film, the processing temperature in rapid processing is generally 38 to 65° C., preferably 40 to 55° C., although a processing temperature generally employed is 30 to 40° C. The development processing time in rapid processing is generally 15 to 195 seconds, preferably 20 to 150 seconds, although a processing time in a usual processing is 1 to 8 minutes. The replenishment per $m^2$ of the light-sensitive material in low-replenishment processing is generally 30 to 390 ml, preferably 50 to 300 ml, and occasionally 80 to 200 ml, although replenishment in standard-replenishment development processing is generally 600 ml or around. In the case where the light-sensitive material to be processed is a color print material like a color print paper, the processing temperature in rapid processing is generally 38 to 65° C., although a processing temperature generally employed is 30 to 40° C. The development processing time in rapid processing is generally 5 to 45 seconds, preferably 5 to 20 seconds, although a processing time in a usual processing is generally 30 seconds to 3 minutes. The replenishment per $m^2$ of the light-sensitive material in low-replenishment processing is generally 10 to 150 ml, preferably 20 to 100 ml, and occasionally 25 to 80 ml, although replenishment in standard-replenishment development processing is generally 161 ml or around. The temperature and processing time in the development step of black-and-white photographic material for shooting and print material are the same as those of the above-mentioned color development.

In color-development processing, the development step is followed by a desilvering step in which treatment by a bleaching solution and a bleach-fixing solution is carried out. The bleaching time is generally 10 seconds to 6 minutes and 30 seconds, preferably 10 seconds to 4 minutes and 30 seconds, and particularly preferably 15 seconds to 2 minutes. In the bleach-fixing according to the present invention, the processing time is generally 5 to 240 seconds and preferably 10 to 60 seconds. The processing temperature is generally 25 to 60° C. and preferably 30 to 50° C. The replenishment per $m^2$ of the light-sensitive material is generally 10 to 250 ml, preferably 10 to 100 ml, and particularly preferably 15 to 60 ml. In black-and-white development processing, the development step is followed by a step in which treatment by a bleaching solution is carried out. The bleach processing time is generally 5 seconds to 240 seconds and preferably 10 to 60 seconds. The processing temperature is generally 25 to 60° C. and preferably 30 to 50° C. The replenishment per $m^2$ of the light-sensitive material is generally 20 to 250 ml, preferably 30 to 100 ml, and particularly preferably 15 to 60 ml.

Generally, the color photographic light-sensitive material undergoes water-washing or a treatment by a stabilization bath after desilvering step, while the black-and-white photographic light-sensitive material undergoes water-washing after fixing. The amount of washing water to be used in the washing step is selected from a broad range depending on characteristics of the light-sensitive material (e.g. the kind of photographic additives, such as couplers), the end use of the light-sensitive material, the temperature of washing water, the number of washing tanks (the number of stages), and other various conditions. For example, the relation between the number of washing tanks and the quantity of water in a multi-stage counter-flow system can be obtained by the method described in "Journal of the Society of Motion Picture and Television Engineers", Vol. 64, pp. 248–253 (May 1955). Generally, the number of steps in a multi-stage counter-flow system is preferably 3 to 15, and particularly preferably 3 to 10.

A multistage, counter-flow method can remarkably reduce the amount of washing water, but this method is associated with such the problems that the increase of the dwell time of water in the tank causes the bacterial growth and that the floating matter thus created adheres to the light-sensitive material. As a means to solve those problems, a stabilization bath containing the aforementioned bacteria- and fungi-preventing agent is preferable.

The pH of the water-washing step or the stabilization step is preferably 4 to 10 and more preferably 5 to 8. Although the temperature may differ depending on the use and property of the light-sensitive material, the temperature is generally 20 to 50° C. and preferably 25 to 45° C. The water-washing and/or stabilization step is followed by drying. From the standpoint of reducing the water amount to be brought into the image film, it is possible to quicken the drying by absorbing water by squeezing roller or cloth immediately after emerging from the water-washing bath. As to the improving means from drier side, it is naturally possible to raise the temperature and to strengthen the drying blow by changing the shape of blowing nozzle, thereby reducing the drying time. Further, as described in JP-A-3-157650, it is also possible to quicken the drying by adjusting the angle of the drying blow to the light-sensitive material and the method for removing the exhaust wind.

In the above, the development processing method by use of the granular processing agent in the system of the present invention is described. Next, the development processing apparatus (processor) for carrying out the development processing will be explained.

The development processing method according to the present invention can be carried out using an automatic processor. The automatic processor that can be preferably used in the present invention is described below. In the present invention, the transfer line speed of the automatic processor is preferably 5000 mm/min or less, more preferably 200 to 4500 mm/min, and particularly preferably 500 to 3000 mm/min. In the processing solution according to the present invention, the area, in which the liquid contacts with air, in the processing tank and the replenisher tank (i.e., aperture or opening ratio) should be as minimized as possible. For example, if an aperture ratio is defined as the value obtained by dividing the open area ($cm^2$) by volume ($cm^3$) of the liquid in the tank, the aperture ratio is preferably 0.01 ($cm^{-1}$) or less, more preferably 0.005 or less, and most preferably 0.001 or less.

In order to decrease the area in contact with air, it is preferable to provide a solid or liquid means floating on the solution surface to protect the solution (replenisher) from contact with air in the processing tank and the replenisher tank. Examples of specifically preferred methods include a method in which a float made of plastics or the like is placed on the liquid surface, and a method in which the liquid surface is covered with a liquid that is immiscible and not reactive with the processing solution. Preferred examples of the liquid are liquid paraffin, liquid saturated hydrocarbons, etc.

In the present invention, in order to carry out the processing rapidly, the time during which the light-sensitive material is in air for being transferred between the processing solutions, i.e., the crossover time is preferably as short as possible. The crossover time is preferably 10 seconds or less, more preferably 7 seconds or less, and further preferably 5 seconds or less. In order to achieve the crossover time in the above-mentioned short time, in the present invention, it is preferable to use a cine-type automatic processor, in particular the one by a leader transfer method. These methods are used in Automatic processor FP-560B (trade name) manufactured by Fuji Photo Film Co., Ltd. The leader and the transfer means of the light-sensitive material are preferably based on the belt transfer methods described in JP-A-60-191257, JP-A-60-191258, and JP-A-60-191259. Besides, in order to shorten the crossover time and to prevent the mixing-in of the processing solution, the structure of a crossover rack fitted with a mixing-preventing plate is preferable.

In the processing solutions for use in the present invention, it is preferable to carry out so-called evaporation correction, that is, supply of water in an amount equivalent to the evaporated amount of the processing solution. This correction is preferable particularly in the color-developing solution, bleaching solution, and bleach-fixing solution. Although the method for supplying the water is not particularly limited, the methods described in JP-A-1-254959 and JP-A-1-254960 are preferable, which methods comprise: providing a monitoring water tank other than a bleaching tank, seeking the amount of evaporated water in the monitoring water tank, calculating the amount of evaporated water in the bleaching tank based on the amount of evaporated water in the monitoring water tank, and supplying water in proportion with the evaporated amount to the bleaching tank. Alternatively, the methods are based on evaporation correction using a liquid level sensor or an overflow sensor. The most preferred correcting method is the one comprising adding water based on the anticipated amount of evaporation and is described in Journal of Technical Disclosure No. 94-49925, right column, line 26, on page 1 to left column, line 28, on page 3, issued from Japan Institution of Innovation and Invention. This method comprises adding water in an amount calculated by the factors based on the operated time and unoperated time of the automatic processor and the information of the time for temperature control.

Further, a measure to reduce the evaporated amount is also necessary. For example, it is required to lessen the aperture area and to control the airflow of the exhausting fan. A preferred aperture ratio of the color-developing solution is described above. Likewise, it is preferable to reduce the aperture area in the case of other processing solutions. As a means to reduce the evaporated amount, it is particularly preferable to "maintain the humidity of the upper space of the processing tank at a value of 80% RH or more" as described in JP-A-6-110171. Further, it is particularly preferable to provide an evaporation preventing rack and a roller-type automatic cleaning mechanism, as described in FIGS. 1 and 2 of the above JP-A-6-110171. An exhausting fan is usually provided for prevention of dew condensation at the time when the temperature is controlled. The drying condition of the light-sensitive material also have an influence on evaporation of the processing solution. The drying method is preferably carried out by use of a ceramic hot air heater, and the supplied airflow is preferably 4 to 20 $m^3$ per minute and particularly preferably 6 to 10 $m^3$ per minute. The overheat preventing thermostat of the ceramic hot air heater is operated preferably by heat conduction, and it is preferable that the thermostat is placed on the windward or leeward side through the radiation fins or heat-conductive region. It is preferable that the drying temperature is adjusted depending on the water content of the light-sensitive material to be processed. The optimum temperature is 45 to 55° C. for an APS (Advanced Photo System) format or 35 mm-wide film, and 55 to 65° C. for Brownie film. When the processing solution is replenished, a supply pump is used. It is preferable that the supply pump is of a bellows type. As for the method of improving the precision of replenishment, it is effective to decrease the diameter of the tube for feeding the solution (replenisher) to the replenisher nozzle, in order to prevent the reverse flow at the time when the pump is stopped.

The drying time is preferably 5 seconds to 2 minutes and more preferably 5 seconds to 60 seconds. In the above, mainly a continuous processing system by a replenisher system is stated. In the present invention, however, a single-use processing system, in which the processing is carried out with a certain amount of processing solution without replenishment for the development step and succeeding steps, and thereafter all or part of the processing solution is replaced with a new solution so that the processing is carried out again, can also be used.

The granular processing agent in the system of the present invention can be supplied to the processor directly as a single-part or plural-part granular composition. The processing agent may be dissolved to prepare a replenisher, and the replenisher is stored in a replenisher tank so that the controlled replenishment is carried out.

Also preferred is a mode, in which a bottle, filled with the granular processing agent and kept with the bottom up, is attached to a processor and the removing of the stopper causes the content (granules) to be dropped in the replenisher tank so that the granules are dissolved in the water. The water to be used for dissolving is preferably the water of the replenisher tank of washing water. It is also possible to replenish the granules as they are directly to the processing tank, and to supply water in an amount proportionate with the dilution ratio directly to the processing tank. In particular, this replenishing system is preferable in a compact processor having no replenisher tank.

The same applies to a granular processing agent composed of plural parts. That is, each granular part is fitted to the upper region of the replenisher thank in the processor, and the each part is automatically dissolved in the water in the replenisher tank in the same manner as above. The water to be used is preferably the water of the replenisher tank of washing water. It is also possible to replenish each granular part directly to the processing tank and to supply water in an amount proportionate with the dilution ratio directly to the processing tank.

The stabilizing solution, as described in JP-A-6-289559, can be preferably used, in order to decrease the adhesion of dirt to the magnetic recording layer coated on the light-sensitive material. The processing specification, which is described in Journal of Technical Disclosure No. 94-4992, right column, line 15, on page 3 to left column, line 32, on page 4, issued from Japan Institution of Innovation and Invention, can also be applied advantageously to the granular processing agent for use in the present invention. The processor to be used in the above is preferably the film processor described in the above-mentioned Journal of Technical Disclosure, right column, lines 22 to 28, on page 3. Specific examples of the automatic processor and evaporation correcting system that are preferable in practicing the granular processing agent that can be used in the present invention, are described in the above-mentioned Journal of Technical Disclosure, right column, line 11 on page 5 to right column, bottom line on page 7.

Next, the light-sensitive materials that can be applied to the photographic processing system of the present invention will be explained. As stated above in connection with the background of the invention, the light-sensitive materials that can be applied to the photographic processing system of the present invention are color photographic light-sensitive materials for shooting, color print papers, photographic black-and-white light-sensitive materials for shooting, and black-and-white print papers commonly used in photographic market. The light-sensitive material is provided at least one light-sensitive layer on a support. A typical example is a silver halide photographic light-sensitive material having on the support at least one light-sensitive layer composed of plural silver halide emulsion layers which have substantially the same color sensitivity but different light sensitivities.

In a multilayer silver halide color photographic light-sensitive material for shooting, a light-sensitive layer is a unit light-sensitive layer that has a color sensitivity to any of blue light, green light and red light. In a multi-layer silver halide color photographic light-sensitive material, such unit light-sensitive layers are generally arranged in the order of a red-sensitive layer, a green-sensitive layer and a blue-sensitive layer from the support side. However, according to the intended use, this order of arrangement can be reversed. Alternatively, the layers may be arranged such that sensitive layers sensitive to the same color can sandwich another sensitive layer sensitive to a different color. Non-light-sensitive layers can be formed as an interlayer between the silver halide light-sensitive layers, or as the uppermost layer or the lowermost layer. These non-light-sensitive layers can contain, for example, couplers, DIR compounds, and color-mixing inhibitors to be described below. Each of the silver halide emulsion layers constituting unit photosensitive layers respectively can preferably take a two-layer constitution composed of a high-sensitive emulsion layer and a low-sensitive emulsion layer, as described in DE Patent No. 1 121 470 or GB Patent No. 923 045. Generally, they are preferably arranged such that the sensitivities are decreased toward the support. As described, for example, in JP-A-57-112751, JP-A-62-200350, JP-A-62-206541, and JP-A-62-206543, a low-sensitive emulsion layer may be placed away from the support, and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH, stated from the side most away from the support. As described in JP-B-55-34932, an order of a blue-sensitive layer/GH/RH/GL/RL stated from the side most away from the support is also possible. Further as described in JP-A-56-25738 and JP-A-62-63936, an order of a blue-sensitive layer/GL/RL/GH/RH stated from the side most away from the support is also possible.

Further as described in JP-B-49-15495, an arrangement is possible wherein the upper layer is a silver halide emulsion layer highest in sensitivity, the intermediate layer is a silver halide emulsion layer lower in sensitivity than that of the upper layer, the lower layer is a silver halide emulsion layer further lower in sensitivity than that of the intermediate layer, so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity, as described in JP-A-59-202464. Further, for example, an order of a high-sensitive emulsion layer/low-sensitive emulsion layer/medium-sensitive emulsion layer, or an order of a low-sensitive emulsion layer/medium-sensitive emulsion layer/high-sensitive emulsion layer stated from the side away from support can be taken. In the case of four layers or more layers, the arrangement can be varied as above.

In order to improve color reproduction, as described in U.S. Pat. Nos. 4,663,271, 4,705,744, and 4,707,436, JP-A-62-160448 and JP-A-63-89850, it is preferable to form a donor layer (CL), which has a spectral sensitivity distribution different from those of a principal (main) light-sensitive layer, such as BL, GL and RL, and which has an inter-layer effect, in a position adjacent or in close proximity to the principal light-sensitive layer.

The preferred silver halide for use in the photographic material for shooting is silver iodobromide, silver iodochloride, or silver iodochlorobromide, each containing about 30 mol % or less of silver iodide. A particularly preferred silver halide is silver iodobromide or silver iodochlorobromide, each containing silver iodide in the range of about 2 mol % to about 10 mol %.

The shape of the silver halide grains in the photographic emulsion may be selected from a regular crystal form such as a cube, octahedron, or tetradecahedron, an irregularly crystal form such as a sphere or a tabular shape, a crystal having a crystal defect such as twin planes, and a complex made up of the foregoing. The grain diameters of the silver halide may be selected form a wide range, since the grains are composed of grains suitable to respective light-sensitive layers. The grains may be fine grains whose projected area diameter ranges from 0.1 to 0.2 $\mu$m or coarse grains whose projected area diameter ranges from 1.0 to 10 $\mu$m. The emulsion may be a polydispersed emulsion or a monodispersed emulsion.

In the color light-sensitive material, the use of a non-light-sensitive, fine-grain silver halide is preferable. The non-light-sensitive, fine-grain silver halide is a fine-grain silver halide that is not light-sensitive at the time of image-wise exposure for obtaining a dye image and is therefore not substantially subjected to development during the development processing. It is preferable that the non-light-sensitive, fine-grain silver halide is not fogged in advance. The fine-grain silver halide has a silver bromide content of 0 to 100 mol % and may contain silver chloride and/or silver iodide, if necessary. Preferably, the fine-grain silver halide has a silver iodide content of 0.5 to 10 mol %. The average grain diameter (average of circle-equivalent diameters, which are diameters of circles corresponding to the projected areas of individual grains) of the fine-grain silver halide is preferably 0.01 to 0.5 $\mu$m and more preferably 0.02 to 0.2 $\mu$m. The fine-grain silver halide can be prepared by the same method as in the preparation of an ordinary light-sensitive silver halide. The optical sensitization of the surface of silver halide grains is not necessary and the spectral sensitization is also unnecessary. However, it is preferable to add a known stabilizing agent such as a triazole compound, an azaindene compound, a benzothiazolium compound, a mercapto compound, or a zinc compound, before the addition of the fine-grain silver halide to a coating solution. The layer containing the fine-grain silver halide grains may contain colloidal silver.

In the color light-sensitive material for use in the present invention, the coating amount of silver is preferable 6.0 g/m$^2$ or less, and particularly preferably 4.5 g/m$^2$ or less. In the color light-sensitive material for use in the present invention, the sum of the film thicknesses of all hydrophilic colloidal layers on the side provided with the emulsion layer is preferably 28 $\mu$m or less, more preferably 23 $\mu$m or less, still more preferably 18 $\mu$m or less, and particularly preferably 16 $\mu$m or less. The film swelling rate $T_{1/2}$ is preferably 30 seconds or less, and more preferably 20 seconds or less. $T_{1/2}$ is defined as a time required to reach ½ the saturated film thickness, which is 90% of the maximum swelled film thickness reached when the film is processed with a color developer at 30° C. for 3 min and 15 sec. The film thickness means the thickness of a film measured under controlled moisture condition, at a temperature of 25° C. and a relative humidity of 55% (two days). $T_{1/2}$ can be measured by using a swellometer of a type described in Photogr. Sci. Eng., by A. Green et al., Vol. 19, 2, pp. 124 to 129. $T_{1/2}$ can be adjusted by adding a film hardener to gelatin as a binder, or changing aging conditions after coating. The swell ratio is preferably 150 to 400%. The swell ratio can be calculated from the maximum swollen film thickness under the conditions above by using the expression: {(maximum swollen film thickness)−(film thickness)}/(film thickness).

On the other hand, in the case of silver halide grains incorporated in a photographic emulsion that is advantageously used in the preparation of prints, the shape of the silver halide grains may be selected from a regular crystal form such as a cube, octahedron, or tetradecahedron, an irregular crystal habit form such as a sphere or a tabular shape, and a complex made up of the foregoing. A pair of parallel planes vertical to the direction of the thickness of a tabular grain are called main faces. In the present invention, it is preferable to use a photographic emulsion containing tabular grains whose main face is a {111} face or tabular grains whose main face is a {100} face. As to the formation of tabular grains whose main face is a {111} face, methods using various crystal phase controlling agents are disclosed. For example, the compounds (compound examples 1 to 42) described in JP-A-2-32 are preferable.

A grain having a high silver chloride content means a grain having a silver chloride content of 80 mol % or more, preferably 95 mol % or more. The grain in the present invention preferably has a so-called core/shell structure composed of a core part and a shell part encircling the core part. It is preferable that 90 mol % or more of the core part is silver chloride. The core part may be composed of two or more parts having different halogen compositions. The shell part is preferably 50% or less, particularly preferably 20% or less, of the total grain volume. It is preferable that the shell part is silver iodochloride or silver iodobromochloride. The iodine content of the shell part is preferably 0.5 to 13 mol % and particularly preferably 1 to 13 mol %. The silver iodide content in the whole grain is preferably 5 mol % or less and particularly preferably 1 mol % or less. It is preferable that the silver bromide content in the shell part is higher than that of the core part. The silver bromide content is preferably 20 mol % or less and particularly preferably 5 mol % or less.

The average grain size (sphere-equivalent diameter, which is the diameter of a sphere corresponding to the volume of an individual grain) of the silver halide grains for use in light-sensitive material for print is not particularly limited, but it is preferably 0.1 to 0.8 μm and particularly preferably 0.1 to 0.6 μm. The circle-equivalent diameter of the tabular grain is preferably 0.2 to 1.0 μm. The (circle-equivalent) diameter means the diameter of a circle whose area is equal to the projected area of the grain under an electron microscope photograph. The thickness is generally 0.2 μm or less, preferably 0.15 μm or less, and particularly preferably 0.12 μm or less. The grain size distribution of the silver halide grains may be of a polydispersed type or a monodispersed type, but a monodispersed type is preferable. In particular, the variation constant of the circle-equivalent diameters of the tabular grains that occupy 50% or more of the total projected area is preferably 20% or less, and ideally 0%.

The following descriptions apply both the color light-sensitive material for shooting and the color light-sensitive material for printing.

The silver halide photographic emulsions that can be used in the present invention may be prepared, for example, by the methods described in Research Disclosure (hereinafter abbreviated to as RD) No. 17643 (December 1978), pp. 22–23, "I. Emulsion preparation and types", and ibid. No. 18716 (November 1979), p. 648, and ibid. No. 307105 (November, 1989), pp. 863–865; the methods described by P. Glafkides, in Chemie et Phisique Photographique, Paul Montel (1967), by G. F. Duffin, in Photographic Emulsion Chemistry, Focal Press (1966), and by V. L. Zelikman et al., in Making and Coating of Photographic Emulsion, Focal Press (1964). Monodispersed emulsions described in U.S. Pat. No. 3,574,628, and U.S. Pat. No. 3,655,394, and U.K. Patent No. 1,413,748 are also preferable.

Tabular grains having an aspect ratio of about 3 or more can also be used, in the light-sensitive suitable for the processing system of the present invention. The tabular grains may be prepared easily, according to the methods described by Gutoff, in Photographic Science and Engineering, Vol. 14, pp.248–257 (1970); U.S. Pat. No. 4,434,226, U.S. Pat. No. 4,414,310, U.S. Pat. No. 4,433,048, and U.S. Pat. No. 4,439,520, and U.K. Patent No. 2,112,157. As to the crystal structure, a uniform structure, a structure in which the internal part and the external part have different halogen compositions, and a layered structure may be acceptable. Silver halides differing in composition may be joined with each other by epitaxial junction, and, for example, a silver halide may be joined with a compound other than silver halides, such as, silver rhodanate and lead oxide. Also, a mixture of grains having various crystal forms may be used.

Although the aforementioned emulsion may be any one of a surface latent image-type that forms a latent image primarily on the grain surface, an internal latent image-type that forms a latent image inside of a grain, and another type of emulsion that forms a latent image both on the surface and inside of the grain; but it must be a negative type emulsion in any case. Among the internal latent image type emulsions, an emulsion of a core/shell-type internal latent image-type emulsion, as described in JP-A-63-264740 may be used, and the preparation method of this emulsion is described in JP-A-59-133542. The thickness of the shell of this emulsion is preferably 3 to 40 nm, and particularly preferably 5 to 20 nm, though it differs depending on development processing or the like.

As the silver halide emulsion, generally, those subjected to physical ripening, chemical ripening, and spectral sensitization are used. Additives in these steps are described in RD Nos. 17643, 18716, and 307105. Its relevant parts are listed in a table described later. In the color photographic light-sensitive material for use in the present invention, it is possible to mix, in a single layer, two or more types of emulsions different in at least one of characteristics of a light-sensitive silver halide emulsion, i.e., a grain size, a grain size distribution, halogen composition, grain shape, and sensitivity. In the present invention, it is preferable to apply surface-fogged silver halide grains described in U.S. Pat. No. 4,082,553, internally fogged silver halide grains described in U.S. Pat. No. 4,626,498 and JP-A-59-214852, or colloidal silver, in light-sensitive silver halide emulsion layers and/or substantially non-light-sensitive hydrophilic colloid layers. The internally or surface-fogged silver halide grain means a silver halide grain which can be subjected to development uniformly (non image-wise) regardless of whether it exists at a non-exposed portion or an exposed portion of the light-sensitive material. A method of preparing the internally or surface-fogged silver halide grain is described in U.S. Pat. No. 4,626,498 and JP-A-59-214852. Silver halides that form the internal nuclei of an internally fogged core/shell-type silver halide grain may have different halogen compositions. As the internally or surface-fogged silver halide, any of silver chloride, silver chlorobromide, silver iodobromide and silver chloroiodobromide can be used. The photographic additives that can be used in the color light-sensitive material are described in the above Research Disclosures (RDs), whose particular parts are given below in the following table.

| Kind of Additive | RD 17643 | RD 18716 | RD 307105 |
|---|---|---|---|
| 1 Chemical sensitizers | p. 23 | p. 648 (right column) | p. 866 |
| 2 Sensitivity-enhancing agents | | p. 648 (right column) | |

-continued

| Kind of Additive | RD 17643 | RD 18716 | RD 307105 |
|---|---|---|---|
| 3 Spectral sensitizers and Supersensitizers | pp. 23–24 | pp. 648 (right column)–649 (right column) | pp. 866–868 |
| 4 Brightening agents | p. 24 | pp. 647 (right column) | p. 868 |
| 5 Light absorbers, Filter dyes, and UV Absorbers | pp. 25–26 | pp. 649 (right column)–650 (left column) | p. 873 |
| 6 Binders | p. 26 | p. 651 (left column) | pp. 873–874 |
| 7 Plasticizers and Lubricants | p. 27 | p. 650 (right column) | p. 876 |
| 8 Coating aids and Surfactants | pp. 26–27 | p. 650 (right column) | pp. 875–876 |
| 9 Antistatic agents | p. 27 | p. 650 (right column) | pp. 876–877 |
| 10 Matting agents | | | pp. 878–879 |

In the color light-sensitive material, various dye-forming couplers may be used. The following couplers are particularly preferred.

Yellow coupler: a coupler represented by formula (I) or (II) in European Patent No. 502,424A; a coupler represented by formula (I) or (II) in European Patent No. 513,496A (especially, Y-28 on page 18); a coupler represented by formula (I) in claim 1 in European Patent No. 568,037A; a coupler represented by formula (I) in lines 45 to 55 in column 1 in U.S. Pat. No. 5,066,576; a coupler represented by formula (I) in paragraph 0008 in JP-A-4-274425; a coupler described in claim 1 on page 40 in European Patent No. 498,381A1 (especially, D-35 on page 18); a coupler represented by formula (Y) on page 4 in European Patent No. 447,969A1 (especially, Y-1 on page 17, Y-54 on page 41); a coupler represented by any of formulas (II) to (IV) in lines 36 to 58 in column 7 in U.S. Pat. No. 4,476,219 (especially, II-17, -19 (column 17), II-24 (column 19)).

Magenta coupler: L-57 (page 11, right and lower column), L-68 (page 12, right and lower column), L-77 (page 13, right and lower column) in JP-A-3-39737; [A-4]-63 (page 134), [A-4]-73, -75 (page 139) in European Patent No. 456,257; M-4, -6 (page 26), M-7 (page 27) in European Patent No. 486,965; M-45 (page 19) in European Patent No. 571,959A; (M-1) (page 6) in JP-A-5-204106; M-22 in paragraph [0237] in JP-A-4-362631.

Cyan coupler: CX-1, 3, 4, 5, 11, 12, 14, 15 (pages 14 to 16) in JP-A-4-204843; C-7, 10 (page 35), 34, 35 (page 37), (I-1), (I-17) (pages 42 to 43) in JP-A-4-43345; a coupler represented by formula (Ia) or (Ib) in claim 1 in JP-A-6-67385.

Polymer coupler: P-1, P-5 (page 11) in JP-A-2-44345.

Preferable examples of couplers, which form a color dye having a suitable diffusive property, include those described in U.S. Pat. No. 4,366,237, GB Patent No. 2,125,570, European Patent No. 96,873B, and DE Patent No. 3,234,533.

Preferable examples of the coupler, which is used for compensating unnecessary absorption of a color dye, include a yellow-colored cyan coupler represented by any of formulae (CI), (CII), (CIII), and (CIV) described on page 5 in European Patent No. 456,257A1 (especially, YC-86 on page 84), a yellow-colored magenta coupler, ExM-7 (page 202), EX-1 (page 249), EX-7 (page 251), described in European Patent No. 456,257A1, a magenta-colored cyan coupler, CC-9 (column 8), CC-13 (column 10), described in U.S. Pat. No. 4,833,069, and a colorless masking coupler, represented by Formula (2) (column 8) in U.S. Pat. No. 4,837,136, and formula (A) in claim 1 in WO92/11575 (particularly the exemplified compounds on pages 36 to 45).

Examples of the compound (including a coupler), which releases a photographically useful group, include the followings:

Development inhibitor releasing compounds: compounds represented by any one of Formulae (I), (II), (III), and (IV) described on page 11 in European Patent No. 378,236A1. Bleaching accelerator releasing compounds: compounds represented by Formula (I) or (I') described on page 5 in European Patent No. 310,125A2.

Ligand releasing compounds: compounds represented by LIG-X described in claim 1 of U.S. Pat. No. 4,555,478. Leuco dye releasing compounds: compounds 1 to 6 in U.S. Pat. No. 4,749,641, columns 3 to 8.

Fluorescent dye releasing compounds: compounds described in claim 1 of U.S. Pat. No. 4,774,181.

Compounds, which release a development accelerator or a fogging agent: compounds represented by Formula (1), (2) or (3) in U.S. Pat. No. 4,656,123, column 3.

Compounds which release a group capable of becoming a dye only after being split-off: compounds represented by Formula (I) described in claim 1 of U.S. Pat. No. 4,857,447.

Examples of additives that can be contained besides couplers include known dispersing media of oil-soluble organic compounds, impregnating latices of oil-soluble organic compounds, scavengers of oxidized forms of developing agents, stain inhibitors, anti-fading agents, film hardeners, precursors of development inhibitors, stabilizers, fogging preventing agents, chemical sensitizers, dyes, fine crystal dispersions of dyes, and UV absorbers.

The present invention can be applied for processing of various color light-sensitive materials, such as color negative films for general purposes or movies, color reversal films for slides or television, color papers, color positive films. Further, the present invention can also be preferably applied for processing of film unites with a lens, as described in JP-B-2-32615 and JU-B-3-39784 ("JU-B" means examined Japanese Utility-model Registration Publication).

A support that can be suitably used in a light-sensitive material to which the processing system of the present invention can be applied, is described in, for example, the above-described R.D. No. 17643 (page 28), R.D. No. 18716 (page 647, right column to page 648, left column) and R.D. No. 307105 (page 879).

In the color light-sensitive material to which the processing system of the present invention can be applied, hydrophilic colloid layers (referred to as backing layers) having a total dried film thickness of 2 to 20 $\mu$m are preferably provided on the side opposite to the side having emulsion layers. The backing layers preferably contain, the aforementioned light absorbents, filter dyes, ultraviolet absorbents, antistatic agents, film hardeners, binders, plasticizers, lubricants, coating aids, and surfactants. The swell ratio of the backing layer is preferably 150 to 500%.

The color light-sensitive material to which the processing system of the present invention can be applied, has a magnetic recording layer in many cases. The magnetic recording layer refers to a layer provided by coating a base (support) with an aqueous or organic solvent-coating solution containing magnetic particles dispersed in a binder.

In a color paper for color print, a reflective type support is generally used. As the reflective type support, it is preferable to use a reflective support having a substrate laminated thereon with a plurality of polyethylene layers or polyester layers (water-proof resin layers or laminate layers), at least one of which contains a white pigment such as titanium oxide.

Further, It is preferable that the water-resistant resin layer contains a fluorescent brightening agent. The fluorescent brightening agent may be dispersed in a hydrophilic colloid layer of the light-sensitive material. Preferred fluorescent brightening agents that can be used are benzoxazole-based compounds, coumarin-based compounds, and pyrazoline-based compounds. More preferred fluorescent brightening agents are benzoxazolylnaphthalene-based compounds and benzoxazolylstilbene-based compounds. Although the amount to be used is not particularly limited, it is preferably 1 to 100 mg/m$^2$. When the fluorescent brightening agent is incorporated in the water-resistant resin layer, the proportion of the fluorescent brightening agent is preferably 0.0005 to 3% by mass, more preferably 0.001 to 0.5% by mass, to the resin. The reflective support may be composed of a transmissive support or a reflective support like the one mentioned above, each of which is coated with a hydrophilic colloid layer containing a white pigment. Alternatively, the reflective support may be a support having a metal surface having mirror reflectivity or secondary diffusion reflectivity.

In the color light-sensitive material for shooting, a cellulose triacetate or polyester support can be used. Details of these supports are described in JIII Journal of Technical Disclosure No.94-6023 (Japan Institute of Invention & Innovation, Mar. 15, 1994). Polyester for use in the present invention is formed from a diol and an aromatic dicarboxylic acid as essential components. Examples of the aromatic dicarboxylic acid include 2,6-, 1,5-, 1,4-, and 2,7-naphthalene dicarboxylic acids, terephthalic acid, isophthalic acid, and phthalic acid. Examples of the diol include diethyleneglycol, triethyleneglycol, cyclohexanedimethanol, bisphenol A, and bisphenol. Examples of the polymer include homopolymers such as polyethyleneterephthalate, polyethylenenaphthalate, and polycyclohexanedimethanol terephthalate. Polyester containing 50 to 100 mole % of a 2,6-naphthalenedicarboxylic acid component is particularly preferable. Polyethylene-2,6-naphthalate is particularly preferable among the above polymers. The average molecular mass is generally in the range of about 5,000 and 200,000. The Tg of the polyester for use in the present invention is generally 50° C. or higher, preferably 90° C. or higher. Into the polyester may be blended (kneaded) an ultraviolet absorber. Further, prevention of light piping can be attained by blending dyes or pigments commercially available for polyesters, such as Diaresin (trade name, manufactured by Mitsubisi Chemical Industries Ltd.), and Kayaset (trade name, manufactured by Nippon Kayaku Co., Ltd.).

These supports are preferably subjected to a surface treatment, after providing a subbing layer or directly, in order to achieve strong adhesion between the support and a photographic constituting layer of the light-sensitive material to which the processing system of the present invention can be applied. As the above-mentioned surface treatment, various surface-activation treatments can be used, such as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, and an ozone oxidation treatment. Among the surface treatments, an ultraviolet irradiation treatment, a flame treatment, a corona treatment, and a grow treatment are preferable.

Further, in the light-sensitive material to which the processing system of the present invention can be applied, an antistatic agent is preferably used. As the antistatic agent, polymers containing a carboxylic acid, a carboxylate, or a sulfonate; cationic polymers, and ionic surface-active compounds can be mentioned. Most preferable antistatic agents are fine particles of at least one crystalline metal oxide selected from the group consisting of zinc oxide, silicon dioxide, titanium dioxide, alumina, indium oxide, magnesium oxide, barium oxide, manganese oxide, and vanadium oxide, and having a specific volume resistance of $10^7$ Ωcm or less, and more preferably $10^5$ Ωcm or less and a particle size of 0.001 to 1.0 μm, or fine particles of their composite oxides (Sb, P, B, In, S, Si, C, and the like); as well as fine particles of the above metal oxides in the form of a sol, or fine particles of composite oxides of these. The content thereof in the light-sensitive material is preferably 5 to 500 mg/m$^2$, and particularly preferably 10 to 350 mg/m$^2$. The ratio of the amount of the electroconductive crystalline oxide or its composite oxide to the amount of the binder is preferably from 1/300 to 100/1, and more preferably from 1/100 to 100/5.

A color light-sensitive material preferably has a slip property. Slip agent-containing layers are preferably formed on both the sides of a light-sensitive-layer side and a back-layer side. A preferable slip property is 0.01 to 0.25 as a coefficient of kinetic friction. This represents a value obtained when a sample is transferred against stainless steel sphere of 5 mm in diameter, at a speed of 60 cm/min (25° C., 60% R.H.). In this evaluation, a value of nearly the same level is obtained when the surface of a light-sensitive layer is used as a partner material in place of the stainless steel sphere. Examples of a slip agent that can be used are polyorganosiloxane, higher fatty acid amide, higher fatty acid metal salt, and ester of higher fatty acid and higher alcohol. As the polyorganosiloxane, it is possible to use, e.g., polydimethylsiloxane, polydiethylsiloxane, polystyrylmethylsiloxane, or polymethylphenylsiloxane. A layer to which the slip agent is added is preferably the outermost emulsion layer or a backing layer. Polydimethylsiloxane and ester having a long-chain alkyl group are particularly preferable.

The color light-sensitive material preferably contains a matting agent. This matting agent can be added to either the emulsion side or back side, and especially preferably added to the outermost layer of the emulsion layer side. The matting agent can be either soluble or insoluble in processing solution, and the combination use of both types of the matting agents is preferable. Preferable examples are polymethylmethacrylate grains, poly(methylmethacrylate/methacrylic acid=9/1 or 5/5 (molar ratio)) grains, and polystyrene grains. The grain diameter is preferably 0.8 to 10 μm, and a narrow grain diameter distribution is preferable. It is preferable that 90% or more of all grains have grain diameters 0.9 to 1.1 times the average grain diameter. To increase the matting property, it is preferable to simultaneously add fine grains with a grain size of 0.8 μm or smaller. Examples are polymethylmethacrylate grains (0.2 μm), poly (methylmethacrylate/methacrylic acid=9/1 (molar ratio), 0.3 μm) grains, and polystyrene grains (0.25 μm), and colloidal silica grains (0.03 μm).

In the above, the color light-sensitive materials, to which the processing system of the present invention can be applied, is explained. Excluding the part relating to color formation, the above-mentioned explanation of the photographing and printing color light-sensitive materials substantially applies also to photographing and printing, positive black-and-white light-sensitive materials to which the processing system of the present invention can be applied.

As the printers for the preparation of prints by the development processing according to the photographic processing system of the present invention, use can be made of commonly used printers. The printers are suitable also to a scanning exposure system using cathode rays (CRT), besides the print system using an ordinary negative printer. The cathode ray tube exposure apparatus is simpler and more compact, and therefore less expensive than a laser-emitting apparatus. Further, optical axis and color (hue) can easily be adjusted. In a cathode ray tube which is used for image-wise exposure, various light-emitting materials which emit a light in the spectral region, are used as occasion demands. For example, any one of red light-emitting materials, green light-emitting materials, blue light-emitting materials, or a mixture of two or more of these light-emitting materials may be used. The spectral region are not limited to the above red, green and blue, and fluorophores which can emit a light in a region of yellow, orange, purple or infrared can be used. Particularly, a cathode ray tube which emits a white light by means of a mixture of these light-emitting materials, is often used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, color image signals may be input into a cathode ray tube to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface (area) successive exposure, may be used. Generally, among these methods the surface (area) successive exposure is preferred, from the viewpoint of high image quality enhancement, because a cathode ray tube of high resolution can be used.

The light-sensitive material to which the processing system of the present invention is applicable, can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor or a solid state laser using a semiconductor as an excitation light source. It is preferred to use a semiconductor laser, or a second harmonic generation light source (SHG) comprising a combination of nonlinear optical crystal with a semiconductor or a solid state laser, to make the system more compact and inexpensive. Particularly, to design a compact and inexpensive apparatus having a longer duration of life and high stability, use of a semiconductor laser is preferable; and it is preferred that at least one of exposure light sources should be a semiconductor laser.

When such a scanning exposure light source is used, the maximum spectral sensitivity wavelength of the light-sensitive material to which the processing system of the present invention is applicable, can be arbitrarily set up in accordance with the wavelength of a scanning exposure light source to be used. Since oscillation wavelength of a laser can be made half using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a photographic material in normal three wavelength regions of blue, green and red. The exposure time in such a scanning exposure is defined as the period of time necessary to expose the size of the picture element (pixel) with the density of the picture element being 400 dpi, and preferred exposure time is $10^{-4}$ sec or less and more preferably $10^{-6}$ sec or less. The light-sensitive material may be provided with a latent image with a micro dot pattern, for the purpose of preventing unlicensed copying of the light-sensitive material which has been processed by the processing according to the present invention. This method is described in JP-A-9-226227.

The scanning exposure system which can preferably be applied to the present invention is described in detail in the publications as shown in the above table. With respect to the processing method of the photographic material to which the processing system of the present invention can be applied, processing materials and processing methods as disclosed in JP-A-2-207250, from page 26, right under column, line 1 to page 34, right upper column, line 9, and JP-A-4-97355, from page 5, left upper column, line 17 to page 18, right under column, line 20, can be preferably applied.

The processing system of the present invention makes it possible to reuse or recycle for use of the photographic processing waste solution, without carrying out desilvering processing. Accordingly, the present invention enables the downsizing and cost reduction of the apparatus in a simple manner, and brings about such an excellent effect that waste solution is not substantially generated. Further, even in rapid running processing, the processing composition (solid processing agent) of the present invention does not cause cyan fading and filter clogging. In particular, when a spray drying method is carried out by a means, such as a spray drier, as a means for obtaining a solidified matter, the processing system of the present invention can exhibit such excellent effect that no staining of the light-sensitive material occurs.

The present invention is described in more detail with reference to the following examples, but the invention is not limited thereto.

EXAMPLES

Example 1

Development processing of a color paper was conducted using a photographic processing system of the present invention.

(1) Preparation of Color Paper

After corona discharge treatment was performed on the surface of a paper support whose both surfaces were laminated with polyethylene resin, a gelatin undercoat layer containing sodium dodecylbenzenesulfonate was formed on that surface. In addition, photographic constituting layers from the first layer to the seventh layer were successively coated on the support, to make a silver halide color photographic light-sensitive material sample (101) having the following layer arrangement.

As a gelatin hardener for each layer, 1-oxy-3,5-dichloro-s-triazine sodium salt (HA-1) was used. Further, to each layer, were added (Ab-1), (Ab-2), (Ab-3), and (Ab-4), so that the total amounts would be 15.0 mg/m$^2$, 60.0 mg/m$^2$, 5.0 mg/m$^2$, and 10.0 mg/m$^2$, respectively.

(Ab-1) Antiseptic

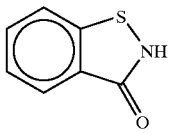

(Ab-2) Antiseptic

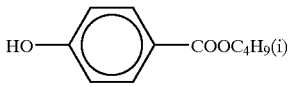

(Ab-3) Antiseptic

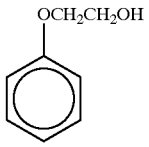

-continued (Ab-4) Antiseptic

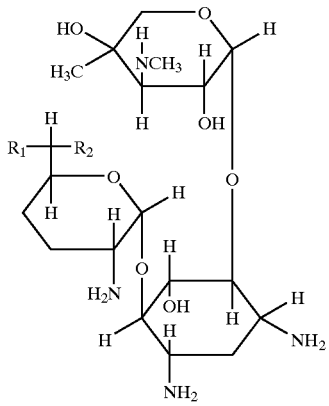

A mixture in 1:1:1:1 of a, b, c, and d

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

(HA-1)

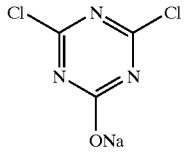

(HA-2) $CH_2{=}CHSO_2CH_2SO_2CH{=}CH_2$

For the silver chlorobromide emulsions of the respective light-sensitive emulsion layers, the following spectral sensitizing dyes were used.

Blue-sensitive emulsion layer (Sensitizing dye A)

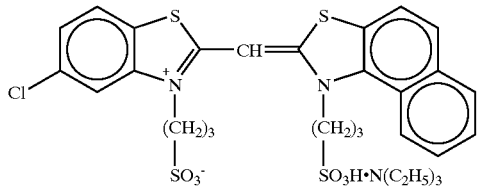

(Sensitizing dye B)

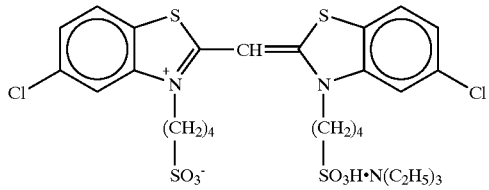

(Sensitizing dye C)

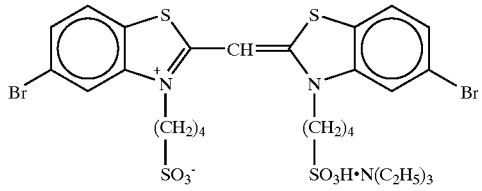

(The sensitizing dyes A, B, and C were added to the large-size emulsion in an amount of $1.4\times10^{-4}$ mol, respectively per mol of silver halide, and to the small-size emulsion in an amount of $1.7\times10^{-4}$ mol, respectively per mol of silver halide.)

Green-Sensitive Emulsion Layer (Sensitizing dye D)

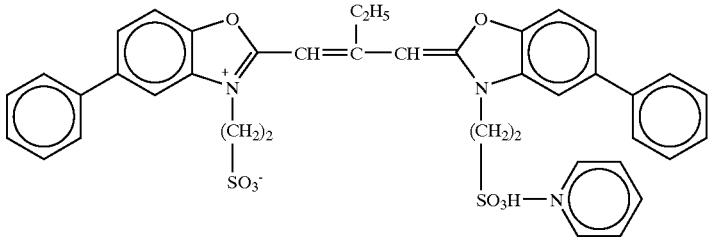

(Sensitizing dye E)

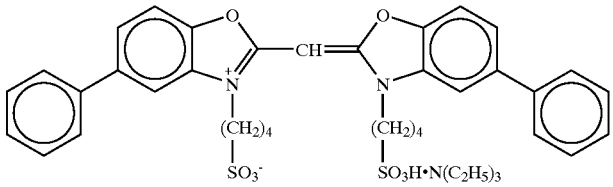

-continued (Sensitizing dye F)

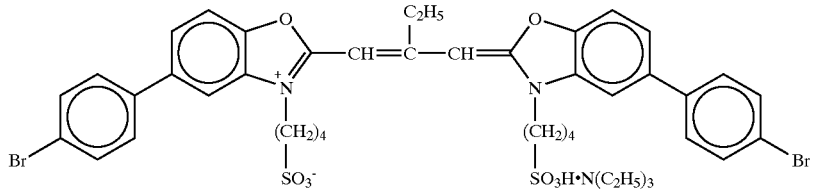

(The sensitizing dye D was added to the large-size emulsion in an amount of $3.0\times10^{-3}$ mol, and to the small-size emulsion in an amount of $3.6\times10^{-4}$ mol, per mol of the silver halide; the sensitizing dye E was added to the large-size emulsion in an amount of $4.0\times10^{-6}$ mol, and to the small-size emulsion in an amount of $7.0\times10^{-5}$ mol, per mol of the silver halide; and the sensitizing dye F was added to the large-size emulsion in an amount of $2.0\times10^{-2}$ mol, and to the small-size emulsion in an amount of $2.8\times10^{-4}$ mol, per mol of the silver halide.)

Red-Sensitive Emulsion Layer (Sensitizing dye G)

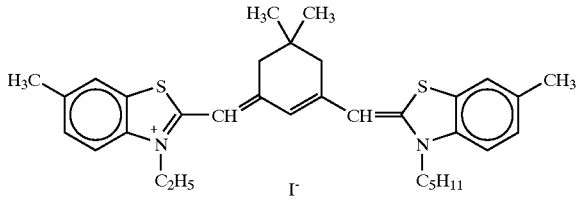

(Sensitizing dye H)

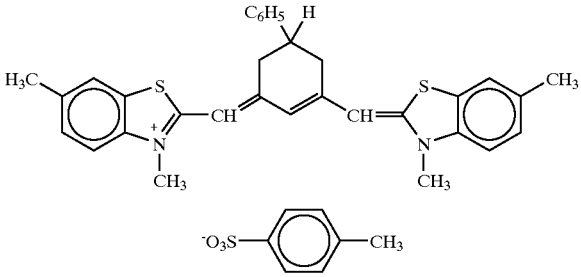

(The sensitizing dyes G and H were added to the large-size emulsion in an amount of $6.0\times10^{-5}$ mol, respectively, per mol of silver halide, and to the small-size emulsion in an amount of $9.0\times10^{-5}$ mol, respectively, per mol of silver halide. Further, the following compound I was added to the red-sensitive emulsion layer in an amount of $2.5\times10^{-3}$ mol per mol of the silver halide.)

(Compound I)

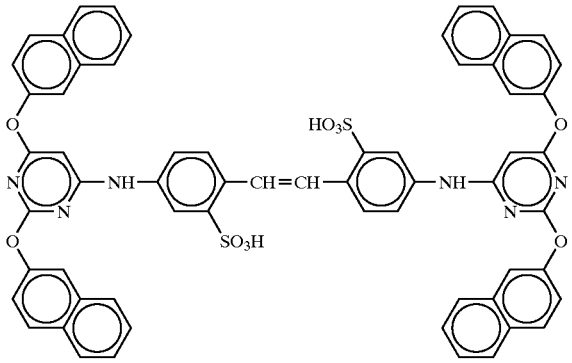

In addition, 1-(3-methylureidophenyl)-5-mercaptotetrazole was added to the blue-sensitive emulsion layer, green-sensitive emulsion layer, and red-sensitive emulsion layer in amounts of $3.3\times10^{-4}$ mole, $1.0\times10^{-3}$ mole, and $5.9\times10^{-4}$ mole, respectively, per mole of silver halide. Further, the same compound was also added to the second layer, the forth layer, the sixth layer and the seventh layer in amounts of 0.2 mg/m$^2$, 0.2 mg/m$^2$, 0.6 mg/m$^2$ and 0.1 mg/m$^2$, respectively. Also, 4-hydroxy-6-methyl-1,3,3a,7-tetrazaindene was added to the blue-sensitive emulsion layer and green-sensitive emulsion layer in amounts of $1\times10^{-4}$ mole and $2\times10^{-2}$ mole, respectively, per mole of silver halide. Further, a copolymer of methacrylic acid and butyl acrylate (ratio by mass, 1:1; average molecular weight, 200,000 to 400,000) was added to the red-sensitive emulsion layer in an amount of 0.05 g/m$^2$. Further, disodium catechol-3,5-disulfonate was added to the second layer, the fourth layer and the sixth layer in an amount of 6 mg/m$^2$, 6 mg/m$^2$, and 18 mg/m$^2$, respectively. Furthermore, to prevent irradiation, the following dyes (the number given in parenthesis represents the coating amount) were added to the emulsion layers.

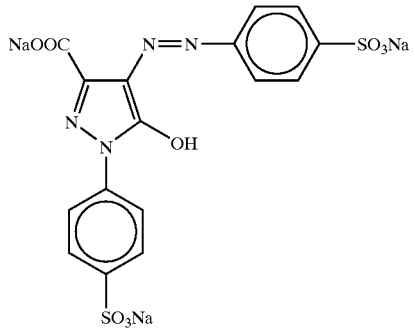

(2 mg/m$^2$)

-continued

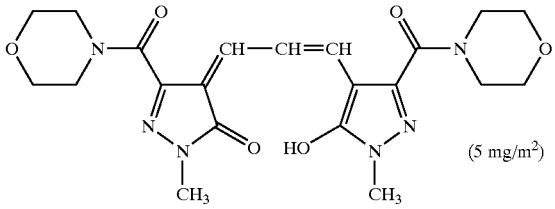

(5 mg/m$^2$)

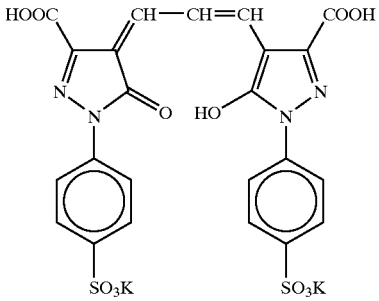

(1 mg/m$^2$)

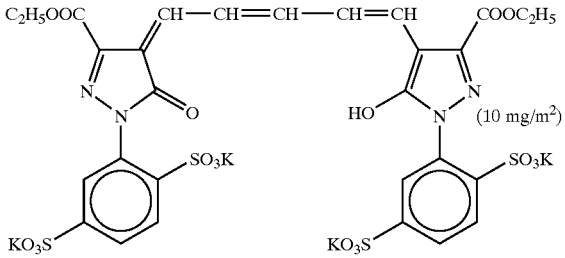

(10 mg/m$^2$)

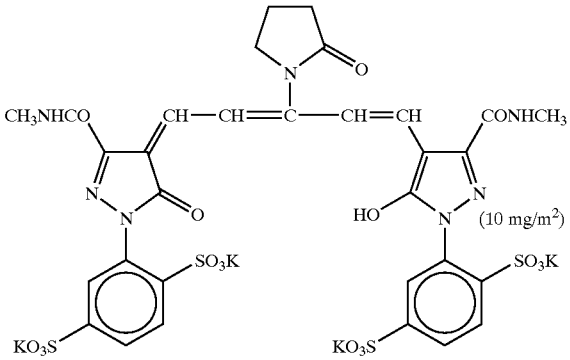

(10 mg/m$^2$)

(Layer Constitution)

The composition of each layer is shown below. The numbers show coating amounts (g/m$^2$). In the case of the silver halide emulsion, the coating amount is in terms of silver.

Support

Polyethylene resin laminated paper {The polyethylene resin on the first layer side contained a white pigment ($TiO_2$; content of 16 mass %, ZnO; content of 4 mass %), a fluorescent whitening agent (a mixture of 4,4'-bis(benzoxazolyl)stilbene and 4,4'-bis(5-methylbenzoxazolyl)stilbene mixed in a ratio of 8/2; content of 0.05 mass %) and a bluish dye (ultramarine)}

| | |
|---|---|
| First Layer (Blue-Sensitive Emulsion Layer) | |
| A silver chlorobromide emulsion A (cubic, a 3:7 mixture of a large-size emulsion A having an average grain size of 0.72 μm, and a small-size emulsion A having an average grain size of 0.60 μm (in terms of mol of silver). The deviation coefficients of the grain size distribution were 0.08 and 0.10, respectively. Each emulsion had 0.3 mol % of silver bromide contained locally in part of the grain surface whose substrate was made up of silver chloride) | 0.25 |
| Gelatin | 1.35 |
| Yellow coupler (ExY-1) | 0.41 |
| Yellow coupler (ExY-2) | 0.21 |
| Color-image stabilizer (Cpd-1) | 0.08 |
| Color-image stabilizer (Cpd-2) | 0.04 |
| Color-image stabilizer (Cpd-3) | 0.08 |
| Color-image stabilizer (Cpd-8) | 0.04 |
| Solvent (Solv-1) | 0.23 |
| Second Layer (Color-Mixing Inhibiting Layer) | |
| Gelatin | 1.00 |
| Color-mixing inhibitor (Cpd-4) | 0.05 |
| Color-mixing inhibitor (Cpd-5) | 0.07 |
| Color-image stabilizer (Cpd-6) | 0.007 |
| Color-image stabilizer (Cpd-7) | 0.14 |
| Color-image stabilizer (Cpd-13) | 0.006 |
| Color-image stabilizer (Cpd-21) | 0.01 |
| Solvent (Solv-1) | 0.06 |
| Solvent (Solv-2) | 0.22 |
| Third Layer (Green-Sensitive Emulsion Layer) | |
| A silver chlorobromide emulsion B (cubic, a 1:3 mixture of a large-size emulsion B having an average grain size of 0.45 μm, and a small-size emulsion B having an average grain size of 0.35 μm (in terms of mol of silver). The deviation coefficients of the grain size distribution were 0.10 and 0.08, respectively. Each emulsion had 0.4 mol % of silver bromide contained locally in part of the grain surface whose substrate was made up of silver chloride) | 0.12 |
| Gelatin | 1.20 |
| Magenta coupler (ExM-1) | 0.13 |
| Ultraviolet absorbing agent (UV-1) | 0.05 |
| Ultraviolet absorbing agent (UV-2) | 0.02 |
| Ultraviolet absorbing agent (UV-3) | 0.02 |
| Ultraviolet absorbing agent (UV-4) | 0.03 |
| Color-image stabilizer (Cpd-2) | 0.01 |
| Color-image stabilizer (Cpd-4) | 0.002 |
| Color-image stabilizer (Cpd-7) | 0.08 |
| Color-image stabilizer (Cpd-8) | 0.01 |
| Color-image stabilizer (Cpd-9) | 0.03 |
| Color-image stabilizer (Cpd-10) | 0.01 |
| Color-image stabilizer (Cpd-11) | 0.0001 |
| Color-image stabilizer (Cpd-13) | 0.004 |
| Solvent (Solv-3) | 0.10 |
| Solvent (Solv-4) | 0.19 |
| Solvent (Solv-5) | 0.17 |
| Fourth Layer (Color-Mixing Inhibiting Layer) | |
| Gelatin | 0.71 |
| Color-mixing inhibitor (Cpd-4) | 0.04 |
| Color-mixing inhibitor (Cpd-5) | 0.05 |
| Color-image stabilizer (Cpd-6) | 0.005 |
| Color-image stabilizer (Cpd-7) | 0.10 |
| Color-image stabilizer (Cpd-13) | 0.004 |
| Color-image stabilizer (Cpd-21) | 0.01 |
| Solvent (Solv-1) | 0.04 |
| Solvent (Solv-2) | 0.16 |
| Fifth Layer (Red-Sensitive Emulsion Layer) | |
| A silver chlorobromide emulsion C (cubic, a 1:4 mixture of a large-size emulsion C having an average grain size of 0.50 μm, and a small-size emulsion C having an average grain size of 0.41 μm (in terms of mol of silver). The deviation coefficients of the grain size distribution were 0.09 and 0.11, respectively. Each emulsion had 0.8 mol % of silver bromide contained locally in part of the grain surface whose substrate | 0.16 |

-continued

| | |
|---|---|
| was made up of silver chloride) | |
| Gelatin | 1.00 |
| Cyan coupler (ExC-1) | 0.05 |
| Cyan coupler (ExC-2) | 0.18 |
| Cyan coupler (ExC-3) | 0.024 |
| Ultraviolet absorbing agent (UV-1) | 0.04 |
| Ultraviolet absorbing agent (UV-3) | 0.01 |
| Ultraviolet absorbing agent (UV-4) | 0.01 |
| Color-image stabilizer (Cpd-1) | 0.23 |
| Color-image stabilizer (Cpd-9) | 0.01 |
| Color-image stabilizer (Cpd-12) | 0.01 |
| Color-image stabilizer (Cpd-13) | 0.01 |
| Solvent (Solv-6) | 0.23 |
| Sixth Layer (Ultraviolet Absorbing Layer) | |
| Gelatin | 0.46 |
| Ultraviolet absorbing agent (UV-1) | 0.14 |
| Ultraviolet absorbing agent (UV-2) | 0.05 |
| Ultraviolet absorbing agent (UV-3) | 0.05 |
| Ultraviolet absorbing agent (UV-4) | 0.04 |
| Ultraviolet absorbing agent (UV-5) | 0.03 |
| Ultraviolet absorbing agent (UV-6) | 0.04 |
| Solvent (Solv-7) | 0.18 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-14) | 0.01 |
| Surface-active agent (Cpd-15) | 0.01 |

(ExY-1) Yellow coupler

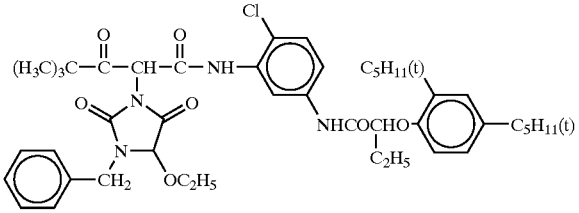

(ExY-2) Yellow coupler

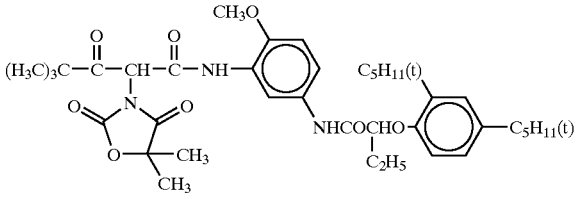

(ExM-1) Magenta coupler

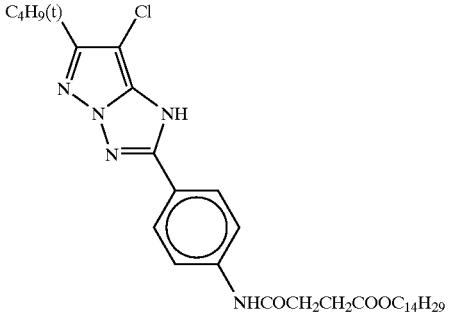

(ExC-1) Cyan coupler

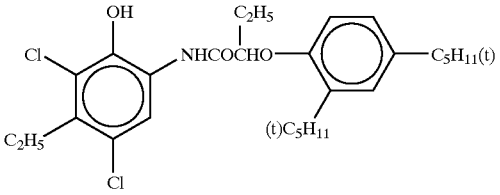

(ExC-2) Cyan coupler

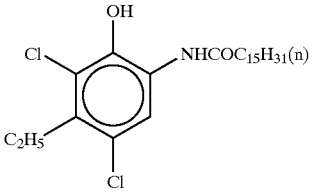

(ExC-3) Cyan coupler

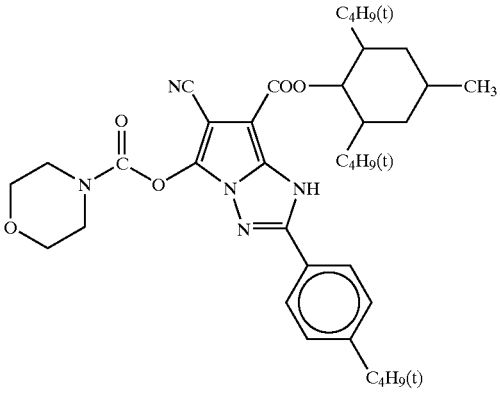

(Cpd-1) Color-image stabilizer

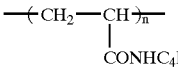

number-average molecular weight 60,000

(Cpd-2) Color-image stabilizer

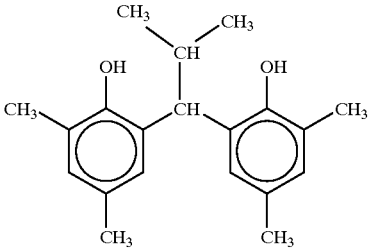

(Cpd-3) Color-image stabilizer

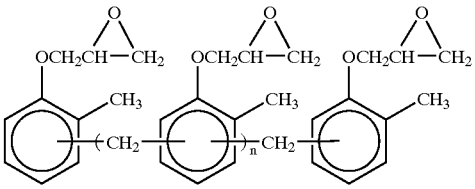

n = 7~8 (average value)

-continued
(Cpd-4) Color mixing inhibitor
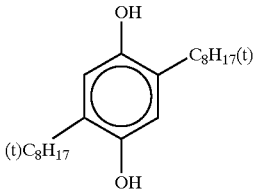
(Cpd-5) Color-mixing inhibitor
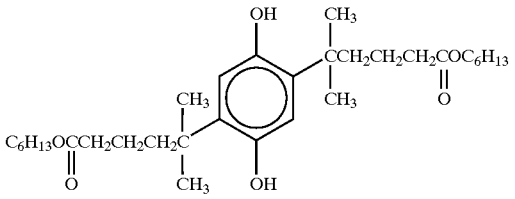
(Cpd-6) Color-mixing inhibitor
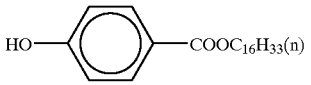
(Cpd-7) Stabilizer
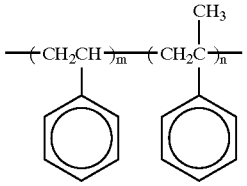
number-average molecular weight 600, m/n = 10/90
(Cpd-8) Color-image stabilizer
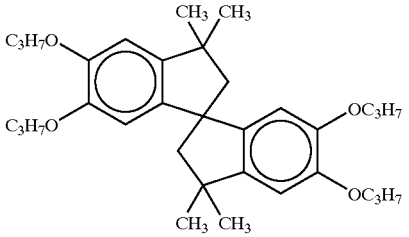
(Cpd-9) Color-image stabilizer
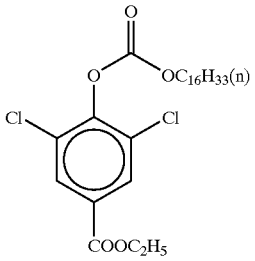
(Cpd-10) Color-image stabilizer
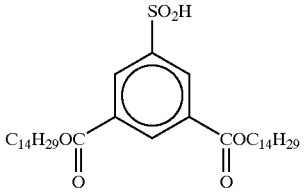
-continued
(Cpd-11)
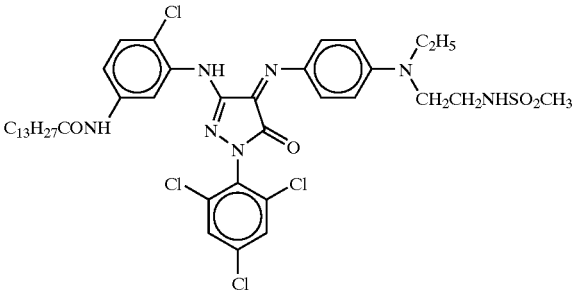
(Cpd-12) Color-image stabilizer
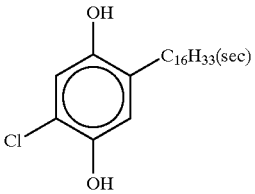
(Cpd-13) Color-image stabilizer
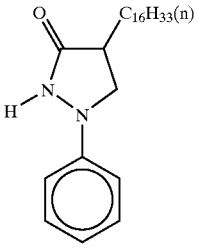
(Cpd-14) Surfactant
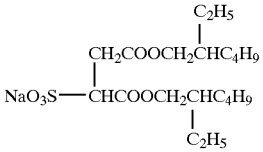
(Cpd-15) Surfactant
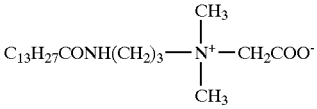
(Cpd-16)
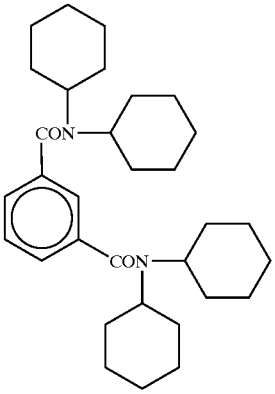

-continued (Cpd-17)

A mixture in 1:1 of

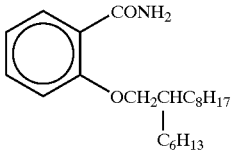

and

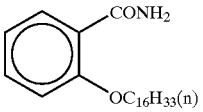

(Cpd-18)

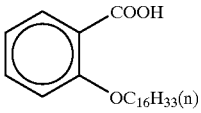

(Cpd-19)

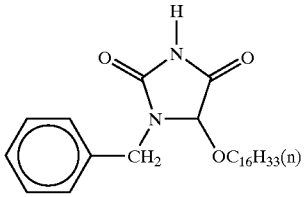

(Cpd-20)

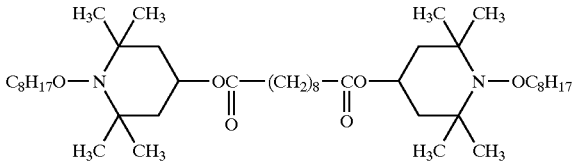

(Cpd-21) Color-image stabilizer

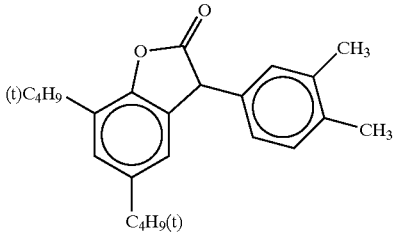

(UV-1) Ultraviolet absorbing agent

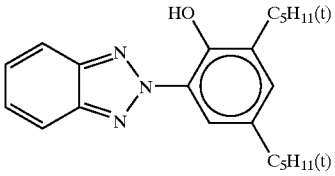

(UV-2) Ultraviolet absorbing agent

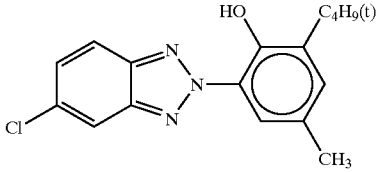

(UV-3) Ultraviolet absorbing agent

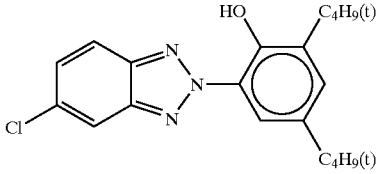

-continued (UV-4) Ultraviolet absorbing agent

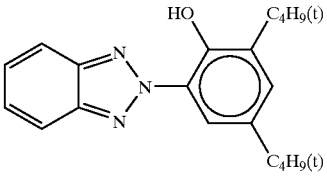

(UV-5) Ultraviolet absorbing agent

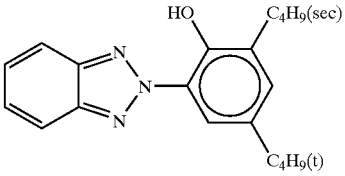

(UV-6) Ultraviolet absorbing agent

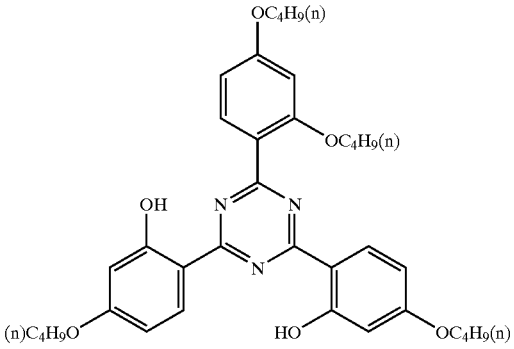

(Solv-1)

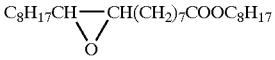

(Solv-2)

A mixture in 1:1 (mass ratio) of

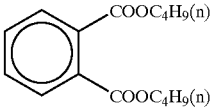

and

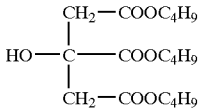

(Solv-3)

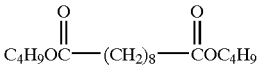

(Solv-4)

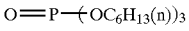

(Solv-5)

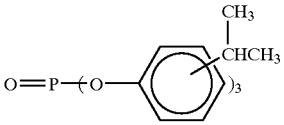

(Solv-6)

A mixture in 1:1 (mass ratio) of

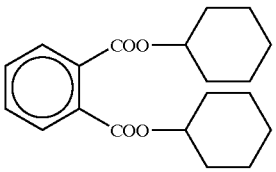

and

-continued

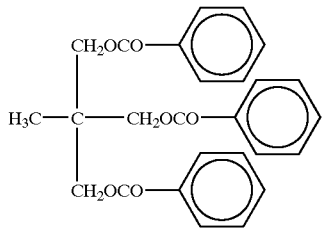

(Solv-7)

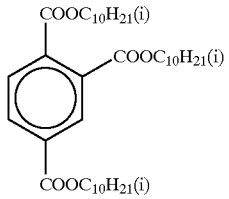

(2) Exposure to Color Paper and Processing Conditions

Using Fuji Color SUPERIA 400 (trade name, manufactured by Fuji Photo Film Co., Ltd.), which is a commercially available color negative film, a photograph of a person was taken in the middle distance under outdoor fine weather. The development processing was carried out using, as a processing apparatus, an automatic processor FP-363SC (trade name, manufactured by Fuji Photo Film Co., Ltd.), and color negative film processing prescription CN-16S including processing agents therefor (each trade names, manufactured by Fuji Photo Film Co., Ltd.).

By using a mini-labo printer processor, Frontier 350 (trade name, manufactured by Fuji Photo Film Co., Ltd.), after the image information of the development-processed color negative film was read, the sample (101) was exposed using a laser exposing unit, and then subjected to the running processing (until the cumulative replenishment of the developing solution reached a volume equivalent to 3 times the tank volume) according to the processing steps and processing solutions shown below.

Frontier 350 that was used underwent the remodeling of tanks and racks so that the processing according to the following steps could be carried out. The remodeling included providing a replenishing apparatus of a rotary feeder system enabling the addition of the granular processing agent directly to the processing tank, and providing a replenishing apparatus enabling the addition of water to the processing tank.

The replenisher for the color development was a mixture composed of the granulated matter 8 and the granulated matter 7 (4:1 by mass) of Example-1 described in JP-A-2001-183779, while the replenisher for the bleach-fixing was prepared according to the preparation method described later.

| | | | Replenisher amount* | |
|---|---|---|---|---|
| Processing step | Temperature | Time | Granular agent | Water |
| Color development | 45° C. | 12 sec | 4 g | 40 ml |
| Bleach-fixing | 40° C. | 12 sec | Shown in Table 1 | 28 ml |
| Rinse (1)** | 40° C. | 5 sec | — | |
| Rinse (2)** | 40° C. | 5 sec | — | |
| Rinse (3)** | 40° C. | 5 sec | — | |

-continued

| | | | Replenisher amount* | |
|---|---|---|---|---|
| Processing step | Temperature | Time | Granular agent | Water |
| Rinse (4)** | 40° C. | 8 sec | — | 180 ml |
| Drying | 80° C. | 10 sec | | |

(Note)
*Replenisher amount per $m^2$ of the light-sensitive material to be processed.
**The rinse was made in a four-tank counter-current system from Rinse (4) to Rinse (1).
***As to waste solutions, overflow solutions at each step were collected and stored in a tank.

Further, a rinsing system of a rinse cleaning system RC50 (trade name), manufactured by Fuji Photo Film Co., Ltd., was employed, and the rinse solution was taken out from the rinse (3) and sent to a reverse osmosis membrane module (RC50D) by using a pump. The permeated water obtained in that module was supplied to the rinse (4), and the concentrated water was returned to the rinse (3). Pump pressure was controlled such that the water to be permeated in the reverse osmosis membrane would be maintained in an amount of 200 to 300 ml/min, and the rinse solution was circulated under controlled temperature for 10 hours a day.

The composition of each processing solution was as follows.

| | |
|---|---|
| (Color-developing solution) | |
| Cation-exchanged Water | 800 ml |
| Dimethylpolysiloxane-series surfactant (Silicone KF351A (trade name), manufactured by Shin-Etsu Chemical Co., Ltd.) | 0.1 g |
| m-Carboxymethylbenzenesulfinic acid | 5.0 g |
| Ethylenediaminetetraacetic acid | 4.0 g |
| Potassium chloride | 10.0 g |
| Potassium bromide | 0.04 g |
| Sodium sulfite | 0.1 g |
| Fluorescent whitening agent Hakkol FWA-SF (trade name, manufactured by Showa Chemicals Inc.) | 4.0 g |
| Sodium p-toluenesulfonate | 20.0 g |
| Potassium carbonate | 27.0 g |
| Disodium N,N-bis(sulfonatoethyl)hydroxylamine | 10.0 g |
| N-ethyl-N-(β-methanesulfonamidoethyl)-3-methyl-4-aminoaniline.3/2 sulfate.monohydrate | 10.0 g |
| Water to make | 1000 ml |
| pH (25° C./adjusted with potassium hydroxide and sulfuric acid) | 10.30 |
| (Bleach-fixing solution) | |
| Water | 600 ml |
| Ammonium thiosulfate (750 g/liter) | 110 ml |
| Ammonium sulfite | 40.0 g |
| Iron (III) ammonium ethylenediaminetetraacetate | 46.0 g |
| Ethylenediaminetetraacetic acid | 5.0 g |
| Succinic acid | 20.0 g |
| Water to make | 1000 ml |
| pH (25° C./adjusted with nitric acid and aqueous ammonia) | 5.50 |
| (Rinsing solution) | |
| Sodium chlorinated-isocyanurate | 0.02 g |
| Deionized water (electroconductivity: 5 μS/cm or less) | 1000 ml |
| pH | 6.5 |

(3) Method for Preparing the Replenisher for the Bleach-fixing Solution

<Preparation A>

At the time point when the waste solution volume reached 230 ml (equivalent to the processing of 1 $m^2$ of the light-sensitive material), the waste solution was powdered by using a spray drier apparatus B-191 (trade name) manufactured by BÜCHI. About 10 g of the resultant powder was sampled. The powder and the granulated matter 7 of Example-2 described in JP-A-2001-183779 were mixed together according to the ratio (by mass) shown in Table 1, and the resultant mixture was used as the replenisher for the bleach-fixing solution of the processing of 1 $m^2$ of the light-sensitive material.

<Preparation B>

As a replenisher for comparison, the waste solution was powdered by using the processing solution recovering apparatus as illustrated in FIG. 1 of JP-A-10-288829 (in which the waste solution was powdered by using an electrolytic apparatus, after removing silver.). About 10 g log of the resultant powder was sampled. In the same manner as above, the powder and the granulated matter were mixed together, and the resultant mixture was used as the replenisher for the bleach-fixing solution of the processing of 1 $m^2$ of the light-sensitive material.

(4) Method for Evaluating Resistance to Cyan-color Fading

By using a sensitometer (manufactured by Fuji Photo Film Co., Ltd., model FW, color temperature of light source: 3200K, exposure time: 0.1 second, exposure amount: 250 CMS), the sample (101) was exposed by gradation exposure through a three-color separation filter for sensitometry. One test piece of the thus-exposed sample was subjected to development processing before start of the running processing and another test piece after completion of the running processing, for each of the processings, as shown in Table 1. The densities of these samples were measured, and each characteristic curve was obtained. From each of the characteristic curves, the maximum density ($D_{max}$) was read, which was measured with red light (filter light corresponding to status A), and the cyan color retention ratio was calculated according to the following equation. With respect to the thus-calculated values, a value of 100% is most preferable, which means that no fading is occurred.

$$(\text{cyan color retention ratio}(\%))=\{(D_{max}\text{ after running})/(D_{max}\text{ before start of running})\}\times 100$$

The results are shown in Table 1.

(5) Method for Evaluating Filter Clogging

In the each running processing using the replenishing agent, as shown in Table 1, the circulating amount of the rinse 2 was measured. Before the start of the running processing, the circulating amount of the rinse 2 was 5 L/min, in each of the processings. The decrease of the flow rate after the running processing was caused by filter clogging. At all tests, the flow rate recovered to 5 L/min by the exchange of the filter with a new one.

The resultant are shown in Table 1.

(6) Method for Evaluating Stain of Light-sensitive Materials

After the completion of the running processing, test pieces of the sample (101), cut into the size of L size (89 mm×127 mm), 2 L size (127 mm×178 mm), and 10×2" size (203 mm×254 mm), were processed without exposure. For the processing, 1 set comprised of L→2 L→10×2" size, and 20 sets were processed. The white backgrounds of the total 60 sheets thus obtained were evaluated with the naked eye according to the following criteria:

○: No occurrence of stain of the light-sensitive material,

Δ: Stain of the light-sensitive material occurred in 1 to 5 spots of 60 sheets, x: Stain of the light-sensitive material occurred in 6 to 10 spots of 60 sheets, and xx: Stain of the light-sensitive material occurred in 11 or more spots of 60 sheets.

The results are shown in Table 1.

TABLE 1

| Sample | Preparation method of replenishing agent | Blended amount of powder and granulated matter (per $m^2$ of light-sensitive material) | Use ratio of waste solution | Resistance to fading of cyan | Circulating amount of rinse 2 after running | Stain of light-sensitive material |
|---|---|---|---|---|---|---|
| (1) | Preparation A | 10 g of powder + 0.7 g of granulated matter | 100% | 98% | 3.6 L/min | x |
| (2) | Preparation A | 8 g of powder + 2.1 g of granulated matter | 80% | 100% | 4.8 L/min | ○ |
| (3) | Preparation A | 6 g of powder + 3.5 g of granulated matter | 60% | 99% | 4.6 L/min | ○ |
| (4) | Preparation A | 4 g of powder + 4.9 g of granulated matter | 40% | 92% | 4.7 L/min | Δ |
| (5) | Preparation B | 10 g of powder + 0.7 g of granulated matter | 100% | 85% | 2.3 L/min | xx |

As can be seen from Table 1, (5), which underwent electrolytic desilvering, caused 15% cyan fading, significant filter clogging, and a large amount of stain in the light-sensitive material. In the case where spray drying was carried out without electrolytic desilvering, (1), which reused 100% of waste solution, caused significant filter clogging, and caused stain in the light-sensitive material, although cyan fading was not so conspicuous; and (4), which reused 40% of waste solution, caused significant cyan fading, and also caused stain in the light-sensitive material, although filter clogging was not so conspicuous. Contrary to these, in Examples (2) and (3) according to the present invention, in which spray drying was carried out without electrolytic desilvering and the reuse ratios of waste solution were within the preferable range of 50 to 90%, surprisingly all of cyan fading, filter clogging, and staining of the light-sensitive material could be prevented.

Example 2

A test was carried out in the same manner as in the example (2) according to the present invention in Example 1, except that the water, which evaporated when the waste solution was powdered, was recovered and reused as the replenishing water for bleach-fixing and rinsing. As a result, the similar performances as those in the example (2) according to the present invention in Example 1 were obtained. Accordingly, it is found that the replenishment can be further reduced.

Having described our invention as related to the present embodiments, it is our intention that the invention not be limited by any of the details of the description, unless otherwise specified, but rather be construed broadly within its spirit and scope as set out in the accompanying claims.

What we claim is:

1. A photographic processing system, comprising:

solidifying a photographic processing waste solution, to give a solidified matter thereof; and reusing part of the solidified matter as a solid processing agent, wherein the solidification of the photographic processing waste solution is carried out without removal of silver ions, and the solidified matter is reused as the solid processing agent.

2. The photographic processing system as claimed in claim 1, wherein the reuse ratio is 50 to 90%.

3. The photographic processing system as claimed in claim 1, wherein spray drying is carried out as a method to obtain the solidified matter from the photographic processing waste solution.

4. The photographic processing system as claimed in claim 1, wherein the solid processing agent is in a granular form.

5. The photographic processing system as claimed in claim 1, further comprising:

liquefying a steam generated at the time of solidifying the photographic processing waste solution by condensing, to give liquefied water; and using the liquefied water as water for replenishing a bleach-fixing solution or a rinsing solution.

6. The photographic processing system as claimed in claim 1, wherein the solid processing agent is used as a bleach-fixing agent.

7. A photographic processing system, comprising:

solidifying a photographic processing waste solution, to give a solidified matter thereof; and reusing part of the solidified matter as a solid processing agent, wherein the solid processing agent is in a granular form and the granular solid processing agent has a core/shell structure, and a critical relative humidity of an internal nucleus that is the core is 70% RH or less.

8. The photographic processing system as claimed in claim 7, wherein the internal nucleus contains at least one of alkali metal hydroxides, thiosulfates, calcium carbonate, hydroxylamine sulfates, and ammonium salts.

9. The photographic processing system as claimed in claim 7, wherein the critical relative humidity of the internal nucleus is 60% RH or less.

10. The photographic processing system as claimed in claim 7, wherein the internal nucleus contains 50% by mass or more of a component whose critical relative humidity is 70% RH or less.

11. The photographic processing system as claimed in claim 7, wherein the internal nucleus is composed of components in which the number of kinds of said components is 4 or less.

12. The photographic processing system as claimed in claim 4, wherein the granular solid processing agent has a core/shell structure, and a critical relative humidity of an internal nucleus that is the core is 70% RH or less.

13. The photographic processing system as claimed in claim 12, wherein the internal nucleus contains at least one of alkali metal hydroxides, thiosulfates, calcium carbonate, hydroxylamine sulfates, and ammonium salts.

14. The photographic processing system as claimed in claim 12, wherein the critical relative humidity of the internal nucleus is 60% RH or less.

15. The photographic processing system as claimed in claim 12, wherein the internal nucleus contains 50% by mass or more of a component whose critical relative humidity is 70% RH or less.

16. The photographic processing system as claimed in claim 12, wherein the internal nucleus is composed of components in which the number of kinds of said components is 4 or less.

* * * * *